US011289787B2

(12) United States Patent
Yang

(10) Patent No.: US 11,289,787 B2
(45) Date of Patent: Mar. 29, 2022

(54) TRANSITION ARRANGEMENT COMPRISING A WAVEGUIDE TWIST, A WAVEGUIDE STRUCTURE COMPRISING A NUMBER OF WAVEGUIDE TWISTS AND A ROTARY JOINT

(71) Applicant: Gapwaves AB, Gothenburg (SE)

(72) Inventor: Jian Yang, Mölndal (SE)

(73) Assignee: GAPWAVES AB, Gothenburg (SE)

( * ) Notice: Subject to any disclaimer, the term of this patent is extended or adjusted under 35 U.S.C. 154(b) by 121 days.

(21) Appl. No.: 16/753,884

(22) PCT Filed: Oct. 25, 2017

(86) PCT No.: PCT/SE2017/051046
§ 371 (c)(1),
(2) Date: Apr. 6, 2020

(87) PCT Pub. No.: WO2019/083418
PCT Pub. Date: May 2, 2019

(65) Prior Publication Data

US 2020/0365962 A1 Nov. 19, 2020

(51) Int. Cl.
*H01P 5/02* (2006.01)
*H01P 1/06* (2006.01)
*H01P 3/12* (2006.01)

(52) U.S. Cl.
CPC ..... *H01P 5/024* (2013.01); *H01P 1/062* (2013.01); *H01P 3/12* (2013.01)

(58) Field of Classification Search
CPC .. H01P 5/024; H01P 1/062; H01P 3/12; H01P 5/04; H01P 1/065; H01P 1/067
(Continued)

(56) References Cited

U.S. PATENT DOCUMENTS 3,001,159 A 9/1961 Hilsinger
3,024,463 A * 3/1962 Moeller ..... H01P 1/17 343/783

(Continued)

FOREIGN PATENT DOCUMENTS

EP 3147994 A1 3/2017
WO 2010003808 A2 1/2010
WO 2017192071 A1 11/2017

OTHER PUBLICATIONS

International Search Report (PCT/ISA/210) and Written Opinion (PCT/ISA/237) dated Jul. 6, 2018, by the European Patent Office as the International Searching Authority for International Application No. PCT/SE2017/051046.

(Continued)

*Primary Examiner* — Rakesh B Patel
*Assistant Examiner* — Jorge L Salazar, Jr.
(74) *Attorney, Agent, or Firm* — Buchanan Ingersoll & Rooney P.C.

(57) ABSTRACT

A transition arrangement for interconnection of waveguide structures or waveguide flanges for forming a waveguide twist, wherein a waveguide twist section arrangement including a number of waveguide twist sections is arranged between the waveguide structures or waveguide flanges for rotating the polarization of waves or signals twisted or forming an angle with an adjacent waveguide flange and/or another adjacent waveguide twist section with respective waveguide openings. The or each twist section on at least one side includes a surface of a conductive material with a periodic or quasi-periodic structure formed by a number of protruding elements allowing waves to pass across a gap between a surface around a waveguide opening to another waveguide opening in a desired direction or waveguide paths, at least in an intended frequency band of operation, (Continued)

and to stop propagation of waves in the gap in other directions.

31 Claims, 15 Drawing Sheets

(58) Field of Classification Search
USPC ..... 333/105, 106, 108, 254, 256, 258, 259
See application file for complete search history.

(56) References Cited

U.S. PATENT DOCUMENTS

| | | | | |
|---|---|---|---|---|
| 3,651,435 | A | 3/1972 | Riblet | |
| 2011/0133863 | A1* | 6/2011 | Lange | H01P 1/171 333/21 A |

OTHER PUBLICATIONS

Kildal, et al., "Local metamaterial-based waveguides in gaps between parallel metal plates", IEEE Antennas and Wireless Propagation letters (AWPL), 2009 (month unknown), vol. 8, pp. 84-87.
Pucci, et al., "Contactless Non-Leaking waveguide flange Realized by Bed of Nails for millimeter wave Applications", 6th European Conference on Antennas and Propagation (EUCAP), Mar. 2012, pp. 3533-3536.
Rahiminejad, et al., "Polymer Gap adapter for contactless, Robust, and fast Measurements at 220-325 GHz", Journal of Microelectromechanical Systems, Feb. 2016, vol. 25, No. 1, pp. 160-169.
Rajo-Iglesias, et al., "Numerical studies of bandwidth of parallel plate cut-off realized by bed of nails, corrugations and mushroom-type EBG for use in gap waveguides", IET Microwaves, Antennas & Propagation, Mar. 2011, vol. 5, No. 3, pp. 282-289.
Sun, et al., "Real time rotatable waveguide twist using contactless stacked air-gapped waveguides", IEEE microwave and wireless component letters, Mar. 2017, vol. 27, No. 3, pp. 215-217.
Wheeler, et al., "Step Twist Waveguide Components", IRE Trans, on Microwave Theory and Techniques, MTT, Oct. 1955, vol. 3, No. 5, pp. 44-52.

* cited by examiner

TRANSITION ARRANGEMENT COMPRISING A WAVEGUIDE TWIST, A WAVEGUIDE STRUCTURE COMPRISING A NUMBER OF WAVEGUIDE TWISTS AND A ROTARY JOINT

TECHNICAL FIELD

The present invention relates to a transition arrangement. The invention particularly relates to arrangements for use in the high, or very high, frequency region, e.g. above 30 GHz, or even in the THz region, but also for frequencies below 30 GHz.

The invention also relates to a waveguide structure comprising a number of waveguide twists, and still further it relates to a rotary joint.

BACKGROUND

In many microwave and millimetre wave systems, the polarization of the waves or signals needs to be rotated with an angle. For example, horizontally polarized waves or signals may need to be rotated to a vertically polarized waves or signals, or vice versa. For that purpose so called polarization twists are needed. The rectangular step twist is a polarization twist which is comparatively easy to realize. Microwave rectangular waveguide step twists were described by H. A. Wheeler and Henry Schwiebert in 1955 in "Step Twist Waveguide Components", IRE Trans. on Microwave Theory and Techniques, MTT, vol. 3, no. 5, pp. 44-52, 1955, and numerous reports which relate to rectangular waveguide step twists have followed. All these rectangular waveguide step twists are made by several pieces of waveguide sections, which then are connected with each other with a certain twisted angle for each section by means of screws or through welding. However, not least for millimetre waves, it becomes very difficult to obtain a good conductive contact between these sections by using screws since actually no screws which are as small as would be required are available, or to achieve a satisfactory precision as far as waveguide dimensions are concerned when using welding, since at the welding spots or locations there will always be comparatively large amounts of welding material representing large volumes, particularly for millimetre wave applications. A very good electric contact is needed in order to avoid leakage and accompanying losses in performance, and reduced bandwidth. Unless the conductive contact is very good, currents will flow between the sections, resulting in a leakage, mismatch and losses which will deteriorate the performance.

Gap waveguide technology is a promising solution for enabling the provisioning of step twists through the use of gap waveguides wherein a good electric contact is achieved in a contact-less manner through the use of a pin structure which is of importance e.g. for millimetre wave applications. If no conductive contact is required between sections, the use of screws or welding might even be disposed of.

In e.g. E. Pucci, P.-S. Kildal, "Contactless Non-Leaking waveguide flange Realized by Bed of Nails for millimetre wave Applications", $6^{th}$ European Conference on Antennas and Propagation (EUCAP), pp. 3533-3536, Prague, March 2012, a waveguide flange which is realized by a bed of pins, and working between 190 and 320 GHz is proposed. This flange, with a pin structure or a textured surface does not require a conductive contact when connected to a standard waveguide, which facilitates fabrication and mounting.

In S. Rahiminejad, E. Pucci, V. Vassilev, P.-S. Kildal, S. Haasl, P. Enoksson, "Polymer Gap adapter for contactless, Robust, and fast Measurements at 220-325 GHz", Journal of Microelectromechanical Systems, Vol. 25, No. 1, February 2016, a double-sided pin-flange gap adapter which is to be placed between two flanges to avoid leakage is disclosed.

In "Real time rotatable waveguide twist using contactless stacked air-gapped waveguides", by Dongquan Sun and Jinping Xu, IEEE microwave and wireless component letters, Feb. 14, 2017, the gap technology has been implemented and a real-time rotatable rectangular waveguide 90° twist is proposed which is based on a modified contactless waveguide flange. The proposed waveguide twist consists of seven layer stacked waveguide plates with a traditional smooth flange on one side and a bed of nails on the opposite side, wherein the waveguide plates are held together by a circular hollow housing and any adjacent plates having a maximum twist-angle of +/−15°.

Even if the use of the gap waveguide technology allows for a good electrical contact by using a pin structure so that no real contact is required, which solves several of the problems referred to above, it is a disadvantage that a large number of steps are required in order not to have a high reflection coefficient and high insertion losses, which makes fabrication costs high and entails a laborious mounting process. The structure is also complex and complicated. In addition, the performance is not as good as would be desired. Still further, it is a drawback that the rotation angle is limited.

Also, in RF systems so called waveguide rotary joints are interesting devices, e.g. for making it feasible with rotating antennas at scanning. For microwave frequencies it is known to make rotary joints comprising a transformer for transforming from a rectangular waveguide to a coax, and from a coax to a rectangular waveguide respectively, where the coax part can be rotated without changing the field distribution in the coax. However, particularly for mm-waves, extremely small coaxes would be needed if applying this type of the rotary joints, which are extremely difficult to fabricate and considerably increases the manufacturing costs. The seven-step twist discussed above in "Real time rotatable waveguide twist using contactless stacked air-gapped waveguides", by Dongquan Sun and Jinping Xu, has been proposed to be used also for providing a rotary joint. However, using seven steps, the rotary joint would never be as stable as required for rotary joints, extremely inflexible, and complicated and expensive to fabricate and would not find any practical use.

Thus, although, through the solution discussed above, the need for a conductive or electric contact is removed, there is still an urgent need for improvement as far as transitions comprising waveguide twists, and also rotary joints, are concerned. There is also a need for providing arrangements and structures appropriate for different and other frequency bands.

SUMMARY

It is therefore an object of the present invention to provide a transition arrangement for interconnection of waveguide structures through which one or more of the above-mentioned problems can be overcome.

It is particularly an object to provide a transition arrangement comprising a waveguide twist which is easy to fabricate and assemble.

It is also an object to provide a transition arrangement comprising a waveguide twist for interconnection of waveguide structures which enables interconnection in a fast and reliable manner with a minimum of interconnecting, e.g. screwing and unscrewing, operations for joining/disconnecting waveguide flanges, and facilitating interconnection.

It is a particular object to provide a transition arrangement comprising a waveguide twist which can be used for high frequencies, e.g. above 10 GHz, or particularly above 30 GHz, or for THz frequencies, particularly for millimetre waves, but also for lower frequencies.

It is a particular object to provide a transition arrangement, and a structure respectively, appropriate for different, and additional, frequency bands, most particularly also for the frequency band 50-75 GHz, e.g. for 60 GHz, and even more particularly for interconnection of V-band flanges.

Particularly it is an object to provide a transition arrangement comprising a waveguide twist which is easy to fabricate and easy to use, and also which is non-expensive.

It is a general object to provide a transition arrangement comprising a waveguide twist through which interconnection as well as disconnection of waveguide structures is facilitated.

It is also an object to provide a transition arrangement comprising a waveguide twist which is robust and suitable for manufacture for different frequency bands, or independently of which is the desired frequency band, and which is very flexible.

Another object is to provide a flexible solution that can be implemented for interconnection of waveguide structures by means of a waveguide twist for operation in different desired frequency bands.

A most particular object is to provide a transition arrangement comprising a waveguide twist which is suitable for being used for interconnections e.g. in measurement systems for high as well as for low frequencies, in connection with different standard waveguides dimensions (such as WR15, WR3,WR12, . . . ) and the corresponding standard waveguide flange dimensions, and for different and wide frequency bands.

A particular object is to provide a transition arrangement comprising a waveguide twist which can be used with standard waveguide flanges.

A general object is to provide a high performance waveguide twist.

It is also a particular object to provide a transition arrangement comprising a wideband or ultra-wideband waveguide twist.

Further yet it is an object to provide a transition arrangement comprising a waveguide twist with a substantially arbitrary rotation angle less than or equal to ±90°.

Further yet it is an object to provide a transition arrangement comprising a waveguide twist with a substantially arbitrary rotation angle less than or equal to ±180°.

It is also an object to provide a transition arrangement with a variable rotation angle, and which can be easily assembled and disassembled.

Therefore a transition arrangement as initially referred to is provided.

Therefore a waveguide structure comprising a number of waveguide twists as initially referred to is also provided.

It is also an object of the present invention to provide a rotary joint through which one or more of the above-mentioned problems can be overcome.

Therefore a rotary joint as initially referred to is provided.

Advantageous embodiments are given by the respective appended dependent claims.

BRIEF DESCRIPTION OF THE DRAWINGS

The invention will in the following be further described, in a non-limiting manner, and with reference to the accompanying drawings, in which.

DETAILED DESCRIPTION

Generally the number of sections in a waveguide step twist is determined by the geometry and the specifications of the twist, especially the requirements as to frequency band. The wider the required bandwidth, the more sections are needed. At each twist interface in a twisted step waveguide, a shunt inductance, a series inductance and a shunt capacitance are introduced. The shunt inductance is the dominating component, see e.g. "Step Twist Waveguide Components" by H. A. Wheeler, et. al, IRE Trans. on Microwave Theory and Techniques, MTT, vol. 3, no. 5, pp. 44-52, 1955 referred to above. For known step waveguide twists, each step section has a length of approximately a quarter wavelength in order to convert the inductance at the next section interface to a capacitive component at each interface so that the introduced inductances can be compensated for through the use of the quarter wavelength converters to achieve a low reflection coefficient. Through the use of such a compensation technique the arrangement will be narrow banded due to the use of the quarter wavelength converters. The larger the twist angles, the narrower the bandwidth, and in order to achieve an acceptable bandwidth, many twist sections, and many twists, have been needed.

Figure 1:
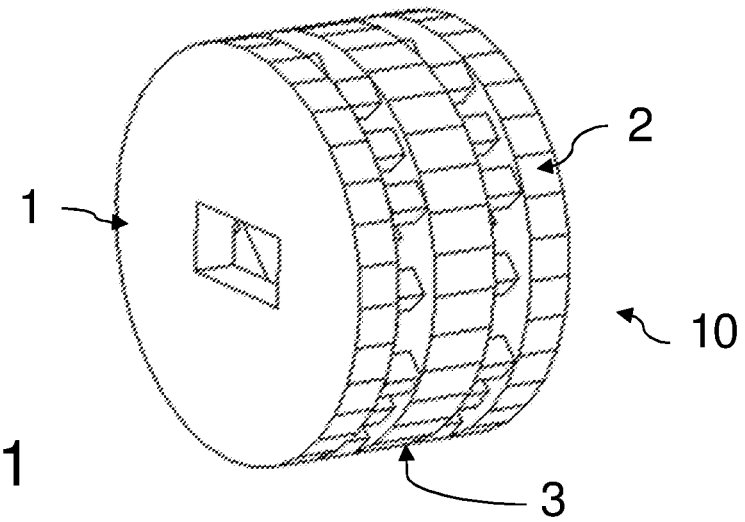
FIG. 1 is a view of a transition arrangement comprising a one-section waveguide twist, here a 90° twist, according to a first embodiment of the present invention in an assembled state in a position between, and interconnecting, two waveguide flanges.

FIG. 1 shows a first embodiment of a waveguide interconnecting or transition arrangement 10 according to the invention comprising a waveguide twist section 3 arranged between, here, a first waveguide flange 1 and a second waveguide flange 2. The first and second waveguide flanges 1,2 here comprise two standard rectangular waveguide flanges which are orthogonally polarized. The twist section 3 is arranged such that a one-section 90° twist is formed and it is arranged to change the polarization of the connection or transition comprising two orthogonally polarized waveguides. The twist section 3 comprises protruding elements 35, here pins, on each opposing side surface thereof allowing a contactless connection to the, here, smooth waveguide flange sections 1,2. The waveguide transition arrangement 10 can be said to comprise a flange adapter element comprising a twist section 3 adapted to be disposed between two waveguide flanges 1,2. The twist section 3 more generally comprises a section with a textured surface 35 (also denoted a periodic or quasi-periodic structure) which here comprises a plurality of protruding pins arranged on the opposing conductive surfaces to form a respective periodic or quasi-periodic structure 35 on each side of the twist section 3. The protruding elements, e.g. the pins, stop the propagation (leakage) of waves through the gaps between the sections. The thickness of the twist section is substantially given by the lengths of the protruding elements, which is about V2 (for protruding elements on both sides; V4 if protruding elements are provided on one side only as described with reference to alternative embodiments below) plus the thickness of the plate of the waveguide thickness which e.g. has a thickness between 0.5 and 1 mm, or somewhat more or less. The invention is not limited to any particular thickness, but it should be such as to have a hardness which is sufficient, also for having protruding elements one either sides, or on one side only. The waveguide flange sections 1,2 are here identical except for the rotation angles around the waveguide axes. The waveguide flange sections 1,2 are here just flat waveguide pieces, the thicknesses of which are mainly determined by the mechanical requirements for the waveguide flange sections or the plates to have a sufficient hardness for being flat. A cavity 34 is provided between each respective waveguide section 31 opening and the surrounding protruding elements, here the pin structure 35. Thus, utilizing the wave stop characteristics of the protruding elements, here pins, the provisioning of a cavity surrounded by the protruding elements and the edges of the waveguide section 31 openings is enabled. To compensate for the inductances introduced by the twist at each twist section interface, compensating capacitances are hence introduced, and since the inductances and the compensating capacitances are substantially co-located along the direction of propagation of the waveguide, this compensation has a wideband performance, and therefore, a fewer number of twist sections, in this embodiment only one twist section, or three steps, is sufficient for a 90° twist, which is extremely advantageous and very efficient.

Through the arrangement of the twist section 3 according to the invention, the polarization can be changed as referred to above with a minimum of reflection.

Figure 1A:
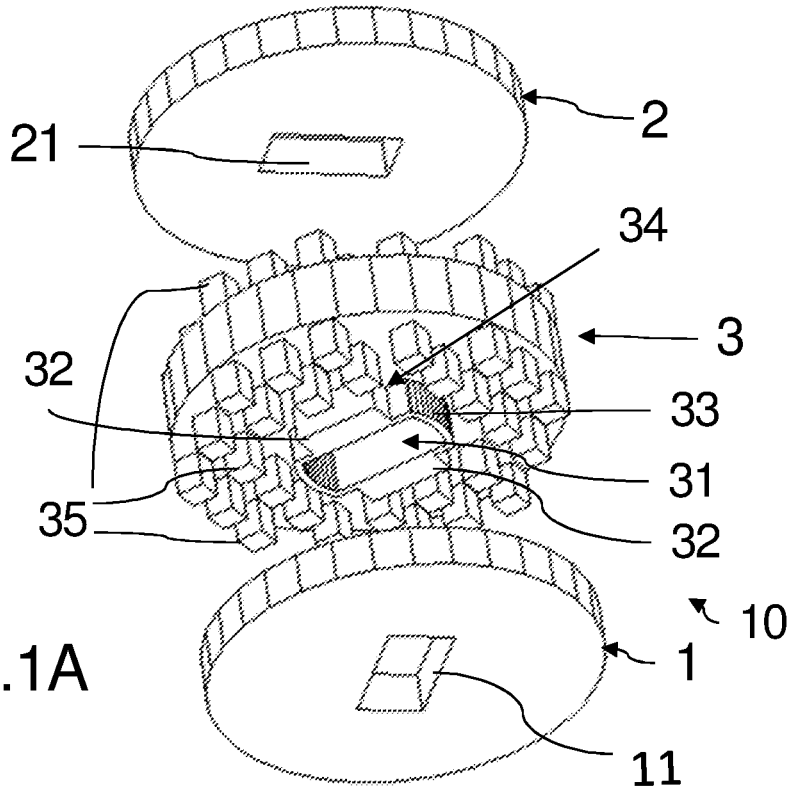
FIG. 1A shows the transition arrangement comprising a waveguide twist of FIG. 1 with the twist section in a non-assembled state.

FIG. 1A is a view in perspective of the transition or interconnecting arrangement of FIG. 1 in a disassembled or non-assembled state. The first waveguide flange 1 may comprise a standard or a non-standard rectangular waveguide flange e.g. of a rectangular or circular shape and a standard or a non-standard waveguide 11. The second waveguide flange 2 may be a standard or a non-standard waveguide flange with a standard or non-standard waveguide 21, but with a polarization which is orthogonal to the polarization of the first waveguide 11. The interconnection waveguide twist section 3 is adapted to be disposed between the first and second waveguide flanges 1,2 which here have smooth surfaces facing the side surfaces of the waveguide twist section 3. The waveguide twist section 3 comprising waveguide section 31 comprises pins 35 on both sides of the plate. The length of the pins 35 is about a quarter wavelength of the centre operation frequency of the arrangement, and in advantageous embodiments the twist section 3 plate also has a thickness of about a quarter wavelength of the centre operation frequency of the arrangement. The waveguides 11,21 are orthogonal, the waveguide openings forming an angle of about 90° with each other, and the waveguide twist section waveguide 31 forms an angle of about +/−45° with the first and the second waveguides 11,21 respectively.

The periodic or quasi-periodic structure or the structure comprising a plurality of pins 35 is, as referred to above, arranged to surround the rectangular waveguide opening on each side of the through waveguide 31 in the waveguide twist section 3. Metal rim or ridge sections or frame surfaces, also called wing sections, are provided such that two wide side wing sections 32,32 are provided on the respective long, wide, sides of the waveguide 31 opening and two shorter, here curved, rim or narrow side wing sections 33,33 are provided on the short or narrow sides of the waveguide openings. The height of the wing sections 32,33 is here substantially the same as the height of the protruding elements 35 of the periodic or quasi-periodic structure. The wide side wing sections 32,32 may e.g. have a width of about $\lambda/4$, $\lambda$ being the wavelength in the waveguide structure (not shown to scale in FIG. 1 etc.), and serve the purpose of, together with the opposite smooth waveguide flanges 1,2 with which the waveguide twist section 3 is to be interconnected, form an impedance transformer which transforms an open circuit to a short circuit to avoid leakage and reflections which may be created at the interfaces between the waveguide twist section 3 and the waveguide flanges 1,2.

Through using the wave stopping features of the periodic structure, here the pin structure 35, it is easy to provide a cavity 34 between the gap pins 35 and the waveguide edges, or rim or ridges 32,32 to compensate for the inductance introduced by the twist at each twist interface. Since the inductance and the compensating capacitance are substantially co-located, i.e. are provided at the same locations along the direction of propagation of the waves in the waveguides, the quarter wavelength impedance converters are not needed any more, therefore a wideband performance is enabled with fewer sections.

Figure 1B:
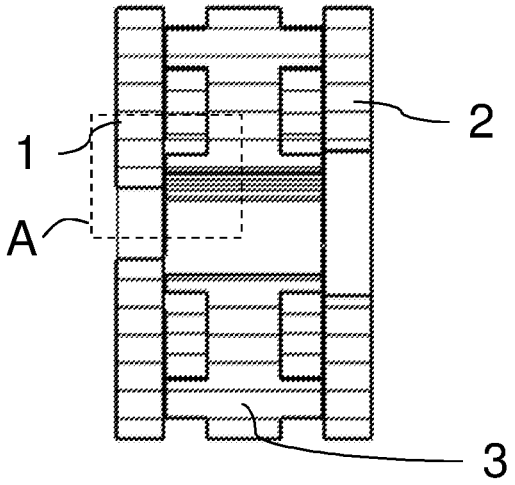
FIG. 1B is a schematic view in cross-section of the transition arrangement comprising the waveguide twist of FIG. 1 in an assembled, interconnecting, state.

FIG. 1B schematically illustrates the 90° one-section gap waveguide twist comprising one twist section 3 interconnecting the two orthogonally polarized rectangular waveguide flanges 1,2 of FIG. 1.

Figure 1C:
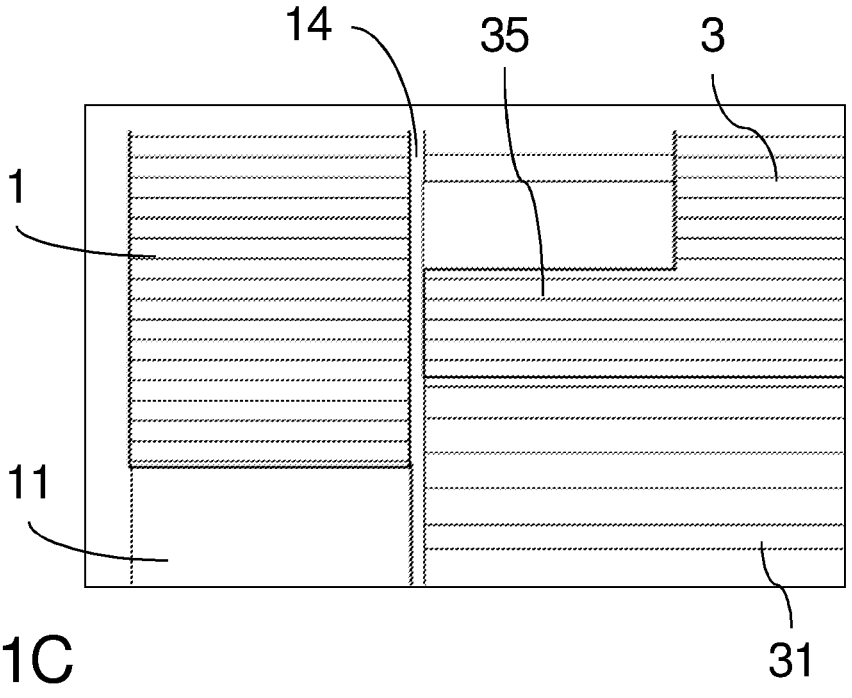
FIG. 1C is an enlarged view of a part of the cross-sectional view in FIG. 1B.

FIG. 1C is an enlarged view of a portion, "A" in FIG. 1B, illustrating a gap 14 between the waveguide flange 1 and the twist section 3. The gap preferably is less than 0.05 mm for 70-90 GHz, e.g. about 0.02 mm, or more generally about 2% of the operation wavelength.

The waveguide twist section 3 is adapted to provide a twist between two waveguide structures or components, e.g. also antennas, filters, receivers etc., here with conventional smooth waveguide flanges.

A protective or supporting element, e.g. an outer rim (not shown) may be disposed such as to surround the periodic or quasiperiodic structure e.g. comprising pins 35. The purpose of such a protective or supporting element is to act as a protective distance element assuring that, if, or when, interconnecting or fastening elements press the periodic or quasiperiodic structure 35, the textured surface, against a waveguide flange with which it is to be interconnected, it is the protective or supporting element that will be exposed to the pressure and the protruding elements 35 of the periodic or quasi-periodic structure will be protected. Further, since such an optional protective or supporting element is arranged to protrude a slight distance beyond the outer ends of the protruding elements 35, the pin surface is prevented from coming into direct mechanical contact with an opposing waveguide flange when interconnected, which otherwise might lead to the textured surface and/or the smooth surface of the interconnecting waveguide flange being damaged or ruined. The waveguide twist section 3 may also in some embodiments (not shown) comprise a number of alignment pin receiving holes, or alternatively alignment pins, serving the purpose of assuring alignment of the waveguide twist section 3 with the waveguide flanges 1,2. Particularly the waveguide twist section 3 can slide on such alignment pins.

The presence of the gap 14 can be provided or assured also through other means and the arrangement according to the invention is not limited to the provisioning of such a protective distance element.

The waveguide twist section 3 plate preferably comprises a solid part made of brass, Cu, Al or any other appropriate e.g. composite material with a good conductivity, a low resistivity and an appropriate density. It may for example be plated with e.g. Au or Ag in environments where further corrosion protection is needed. It should be clear that also other materials can be used, e.g. any appropriate alloy. It can also be fabricated from a suitable plastic/polymer compound and plated with e.g. Cu, Au or Ag.

The waveguide twist section 3 in the shown embodiment comprises a section on a central portion of which a periodical or quasi-periodic structure, a texture, with protruding elements 35 is disposed around the opening of a rectangular waveguide 31. It should be clear that in alternative embodiments the waveguide twist section 3 may have any other appropriate shape, allowing it to be connected between e.g. two waveguide flanges as referred to above, between a waveguide flange and an antenna or another device, a waveguide flange of a calibrating arrangement, a DUT (Device Under Test) etc. It may in different embodiments be provided as a separate waveguide twist section 3, in other embodiments it may be adapted to be fixedly connected to a waveguide flange, or in still other embodiments be adapted to be connected to another waveguide twist section. It may also form part of a waveguide flange. Still further, instead of being circular, the flanges may have any other shape, such as square shaped, rectangular, ellipsoid or oval. The invention is also not limited to rectangular waveguides but they may e.g. be circular.

The texture, i.e. the periodic or quasi-periodic structure, may e.g. comprise a structure comprising a plurality of protruding elements, e.g. pins 35 having a square shaped cross-section, but the protruding elements can also have other cross-sectional shapes such as circular or rectangular, comprise a corrugated structure, e.g. comprising elliptically disposed grooves and ridges or similar. Other alternative shapes for corrugations are also possible.

The gap waveguide flange adapter element disclosed in PCT/SE2016/050387, by the same applicant, and the content of which herewith is incorporated herein by reference, can be said to form a one-section 0° twist.

Through providing a connection with a twist section between a conductive smooth flange surface or plane of a waveguide on one side and a flange surface with a periodic or quasi-periodic structure on the other side, the polarization of waves or signals can be rotated, here 90° and the waveguides are connected without requiring electrical contact, but also without direct mechanical contact. The presence of a gap 14 (see FIG. 1C), e.g. an air gap, or a gap filled with gas, vacuum, or at least partly with a dielectric material, between two connecting sections is allowed since the periodic or quasi-periodic structure stops all kind of wave propagation between the two surfaces in all other directions than desired wave guiding paths. The periodic or quasi-periodic structure comprising protruding elements 35 is so designed that it stops propagation of waves inside the gap 14 in any direction, whereas waves are allowed to pass across the gap from the waveguide opening in one flange surface to the waveguide opening in the other, at least in the intended frequency band of operation. Thus, the shapes and dimensions and the arrangement of e.g. pins, posts, grooves, ridges etc. of the periodic or quasi-periodic structure are selected such as to prevent propagation of waves in any other direction than the intended direction.

The non-propagating or non-leaking characteristics between two surfaces of which one is provided with a periodic texture (structure), is known e.g. from P.-S. Kildal, E. Alfonso, A. Valero-Nogueira, E. Raj o-Iglesias, "Local metamaterial-based waveguides in gaps between parallel metal plates", IEEE Antennas and Wireless Propagation letters (AWPL), Volume 8, pp. 84-87, 2009. The non-propagating characteristic appears within a specific frequency band, referred to as a stopband. Therefore, the periodic texture and gap size must be designed to give a stopband that covers with the operating frequency band of the standard waveguide being considered in the calibration kit. It is also known that such stopbands can be provided by other types of periodic structures, as described in E. Rajo-Iglesias, P.-S. Kildal, "Numerical studies of bandwidth of parallel plate cut-off realized by bed of nails, corrugations and mushroom-type EBG for use in gap waveguides", IET Microwaves, Antennas & Propagation, Vol. 5, No. 3, pp. 282-289, March 2011. These stopband characteristics are also used to form so called gap waveguides as described in Per-Simon Kildal, "Waveguides and transmission lines in gaps between parallel conducting surfaces", WO2010003808.

Any of the periodic or quasi-periodic textures previously used or that will be used in gap waveguides also can be used in a waveguide structure interconnecting arrangement, a flange adapter element or flange structure of the present invention, and is covered by the patent claims.

The concept of using a periodic texture to improve waveguide flanges is known from P.-S. Kildal, "Contactless flanges and shielded probes", European patent application EP 12168106.8, 15 May 2012.

According to the present invention, the two surfaces, e.g. the textured structure of the twist section, i.e. the plane formed by the free outer ends of the pins or ridges or similar of a periodic or quasiperiodic structure, and a smooth waveguide flange, or another textured surface, must not be separated more than a quarter of a wavelength of a transmitted signal, or rather have to be separated less than a quarter wavelength, which is described in the above-mentioned publications, particularly in E. Raj o-Iglesias, P.-S. Kildal, "Numerical studies of bandwidth of parallel plate cut-off realized by bed of nails, corrugations and mushroom-type EBG for use in gap waveguides", IET Microwaves, Antennas & Propagation, Vol. 5, No 3, pp. 282-289, March 2011.

The periodic or quasi-periodic structure in particular embodiments comprises an array of pins 35 with a cross section e.g. having the dimensions of 0.15λ×0.15, and a height of 0.15-0.25λ.

Through the provisioning of an interface formed by a smooth conductive surface of a waveguide flange 1,2 on one side of the interface and a textured surface, here comprising pins 35, on the other side of the interface, power is prevented from leaking through the gap between the smooth conductive surface and the textured surface, or between two textured surfaces, while a desired twist is provided. Propagation in non-desired directions is prohibited by means of a high impedance, resulting from the provisioning and arrangement of a periodic or quasi-periodic structure.

According to the invention, by using a combination of a surface comprising a periodic or quasi-periodic structure and a waveguide flange 1,2 with a smooth conductive surface, or two surfaces each provided with a periodic structure, waveguides can hence be twisted without the surfaces having to be in electrical contact, and through the provisioning of the cavity 34, and in advantageous embodiments even improved through the arranging of cavity wings or rims or ridges, along the edges of the waveguide openings through which the insertion losses can be further reduced, it becomes possible to make a waveguide twist with only one section as in e.g. FIG. 1, or with a few sections only, which is extremely advantageous, since with e.g. one, two or three twist sections, the arrangement becomes much easier to fabricate, easier to operate, and the losses are lower than with devices requiring a large number of steps, and the gap waveguide step twists according to the invention find many applications e.g. in millimetre wave and THz systems.

Figure 1D:
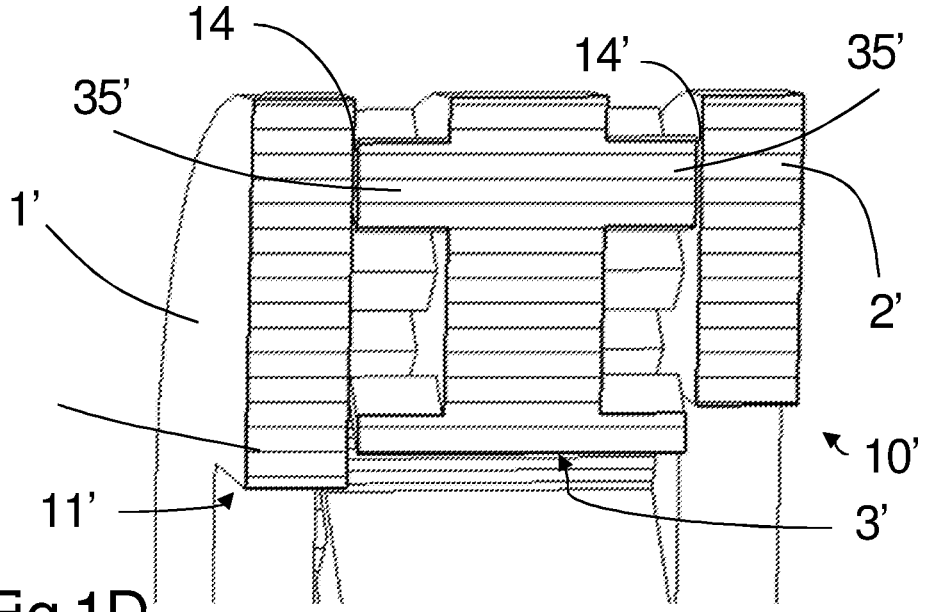
FIG. 1D shows an embodiment similar to the embodiment of FIG. 1, but wherein the distances or gaps between the twist section and the respective waveguide flanges are different.

FIG. 1D shows a part in cross-section of a transition arrangement similar to the one described with reference to FIGS. 1-1C with the difference that the gap 14 between a first waveguide flange 1' and the twist section 3' can be different from a gap 14' provided between the twist section 3' and the other waveguide flange 2', see FIG. 1D.

Figure 1E:
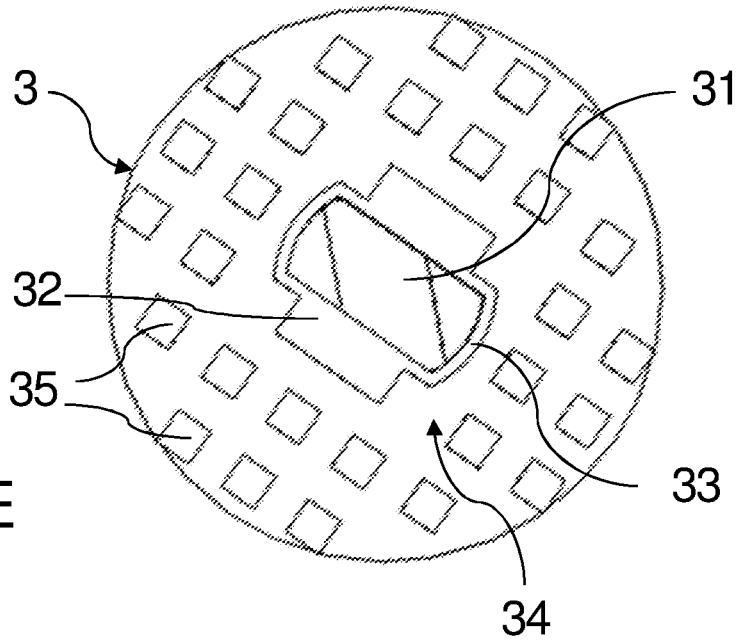
FIG. 1E is a top view showing an exemplary pin geometry of the waveguide twist section of FIG. 1.

FIG. 1E shows an exemplary geometry of the arrangement of pins of the periodic or quasi-periodic structure 35 of the arrangement shown in FIG. 1, or e.g. as shown in FIG. 1D. The arrangement here also comprises long side edge or cavity ridges or wings 32 of a certain width/radius, e.g. a quarter of the operation wavelength (the wavelength at the centre of the operation frequency), and a narrow, short, side edge or narrow side wing sections 33 of a certain width/radius, e.g. an eighth of the wavelength for compensating for the inductance induced by the twist in order to achieve a low reflection coefficient. It should however be clear that the invention is not limited to edge sections with cavity edges or wing sections as shown here, they may also have other shapes and dimensions, and may also be entirely disposed of, on the narrow, short, waveguide sides, or even on the wide, long, waveguide sides, or both. The provisioning of edge sections, wing sections, is hence not necessary for the functioning of the invention, but provide advantageous embodiments in improving the compensation for the created inductances. The wing sections, at the middle of the waveguide opening wide side edges, provide a considerable capacitive coupling from the cavity 34 to the waveguide twist section 3 at the corners of the waveguide, which is the location where the inductance is introduced. Thereby a very efficient capacitive compensation is provided. In the corners the leakage to the cavity 34 is quicker. If there is a capacitance also on the corner, an even better wider band performance can be obtained.

Figure 2:
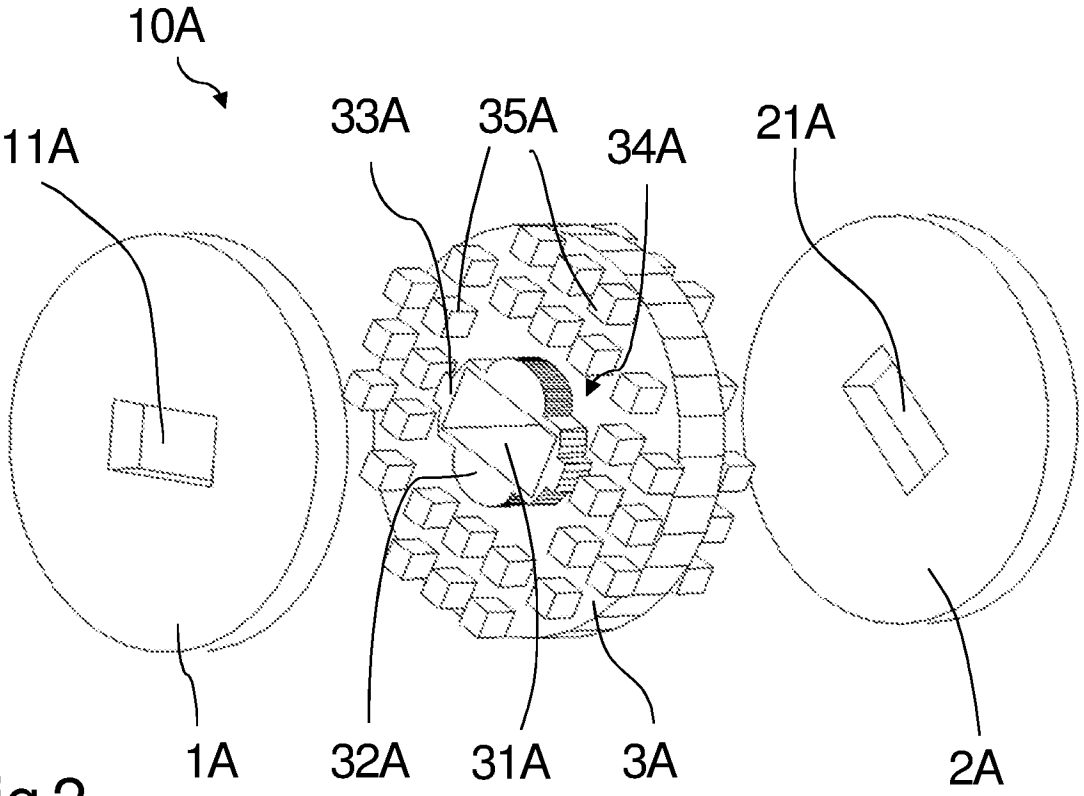
FIG. 2 shows an alternative embodiment of a transition arrangement comprising a one-section waveguide twist, here a 45° twist, adapted to be arranged between two waveguide flanges.

FIG. 2 shows another embodiment of a waveguide interconnecting or transition arrangement 10A according to the invention comprising a waveguide twist section 3A arranged between a first waveguide flange 1A and a second waveguide flange 2A. The first and second waveguide flanges 1A,2A comprise rectangular waveguide flanges, and a standard or non-standard first waveguide 11A is connected to a second standard or non-standard second waveguide 21A in flange 2A. The arrangement here comprises a one section 45° twist, i.e. the polarization angle is twisted 45° via the twist section 3A. The waveguide 31A in the twist section is rotated half of the twist angle of +/−45° with respect to the waveguides 11A,21A. The waveguide 31A may e.g. be a rectangular waveguide or a waveguide with curved narrow walls. Also other alternatives are possible.

The twist section 3A comprises protruding elements, also here pins, 35A on each opposing side surface thereof allowing a contactless connection to the, here, smooth waveguide flange sections 1A,2A. Features having already described with reference to FIG. 1 bear the same reference signs but are indexed "A", and will not be further described herein. Also in this embodiment the waveguide flange sections 1A,2A are identical except for the rotation angles around the waveguide axes. Edge wings 32A are provided along the wide or long walls of the waveguide 31A on the sides of the flange section 3A facing the waveguide flanges 1A,2A. The wide side wing sections 32A are in this embodiment rounded with, here, a wing radius of about a quarter wavelength at the centre operation frequency. The cavity 34A may e.g. have a width, here defined as being in parallel with the direction of the wide wall of the waveguide 31A, of about one wavelength, or somewhat more, whereas the length of the cavity 34A, here defined as being in parallel with the direction of the narrow or short wall of the waveguide 31A, is about one wavelength, or somewhat less. In this embodiment narrow side wing sections 33A are also provided along the narrow or short walls of the waveguide 31A on the sides of the flange section 3A facing the waveguide flanges 1A,2A, and the arrangement comprises a so called double wing 45° twist. Each wide side wing section 32A comprises a central section with a radius of e.g. about a quarter wavelength or somewhat more, e.g. with a width of about 5% of the wavelength, surrounded by two outer sections with e.g. a radius of about a quarter wavelength or somewhat more. The thickness of the twist section 3A with pins on both sides is mainly defined by the pins' length, and may be about half a wavelength, or somewhat more. It should be clear that the dimensions merely are given for exemplifying reasons, and the invention is by no means limited thereto. The different dimensions may be smaller as well as larger, and also the relationships between the different dimensions may vary depending on the waveguide dimensions, the twist angles, the bandwidth and other specification requirements.

Figure 2A:
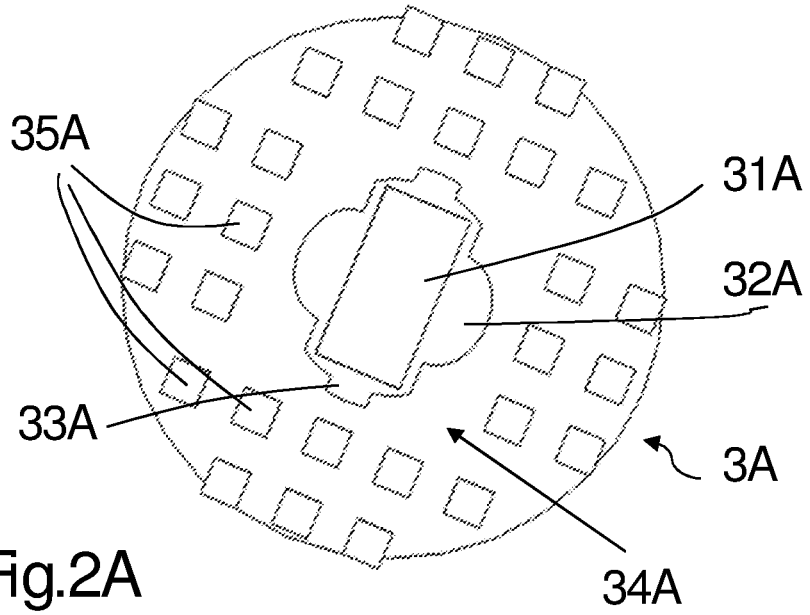
FIG. 2A is a top view showing an exemplary pin and wing geometry of a waveguide twist section as in FIG. 2.

FIG. 2A is a top view of one side of the twist section 3A showing an exemplary geometry of the pins of the periodic or quasi-periodic structure 35A. For the dimensions given above, the pins may in one embodiment have a width of about 15% of the wavelength, a length of about 25% of the wavelength, the pin period (centre-centre distance) being about 35% of the wavelength. It should be clear that the dimensions only are given for exemplifying reasons, and may be larger as well as smaller, and also the relationships may differ. Also, the cross-sectional shape of a pin may be different. It may be square-shaped, circular etc. as discussed above. Generally the length of the pins or protruding elements is about a quarter wavelength of the centre operation frequency. In alternative embodiments such, or other wings, wings 32A are provided along the wide walls of the waveguide whereas there are no wings on the narrow walls.

Figure 2B:
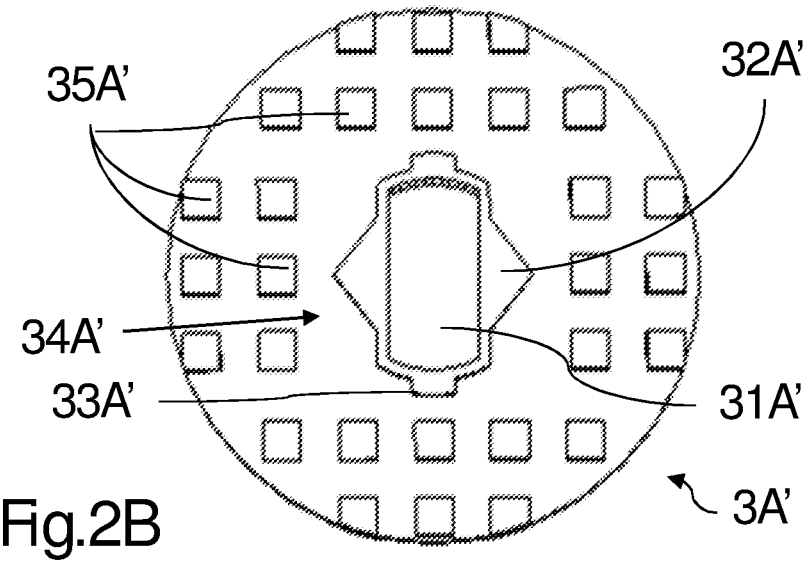
FIG. 2B is a top view showing another exemplary pin and wing geometry of a waveguide twist section as in FIG. 2.

FIG. 2B is a top view of one side of another embodiment of a twist section 3A'. The same reference signs are used for elements corresponding to elements already discussed with reference to FIGS. 2,2A, but are indexed "A'", and will not be further discussed. Edge wings 32A' are provided along the wide or long walls of the waveguide 31A' on the sides of the flange section 3A' facing the waveguide flanges 1A',2A'. The wide side wing sections 32A' are in this embodiment triangular which may have advantages for an easy manufacture and give a better performance for some twist angle. In still other embodiments the wide side wing sections along the wide or long walls of the waveguide may e.g. be elliptical or diamond shaped. In other respects the arrangement 3A' is similar to the embodiment described with reference to FIGS. 2-2A. Edge wings 33A are also provided along the narrow or short walls of the waveguide 31A on the sides of the flange section 3A facing the waveguide flanges 1A,2A, It should be clear that the shapes and the arrangement of wing sections as described herein also may be used for other rotational angles than 45°, e.g. for any angle smaller than 90°. It is also applicable for two or three section arrangements. In alternative embodiments such wing sections 32A' are provided along the wide walls of the waveguide whereas there are no wing sections on the narrow walls.

Figure 3:
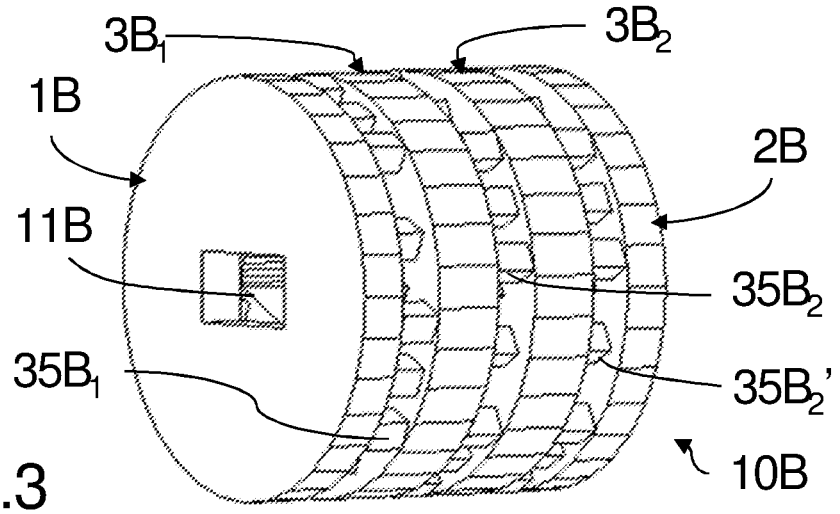
FIG. 3 shows an embodiment of a transition arrangement comprising a two-section 90° twist arranged between two waveguide flanges in an assembled state.
Figure 3A:
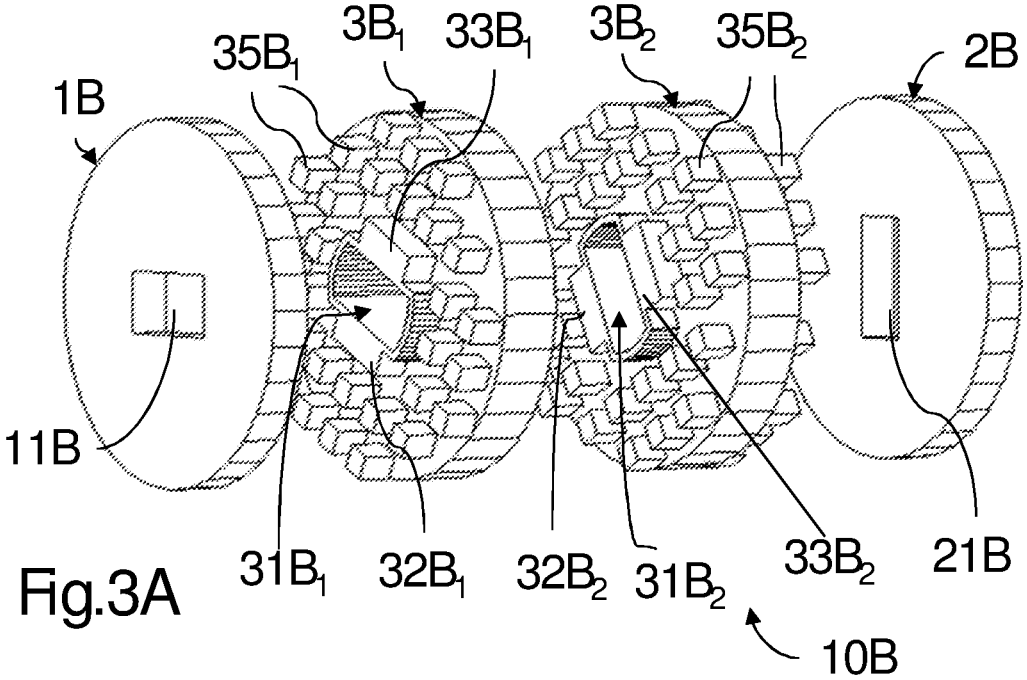
FIG. 3A is a view in perspective of the transition arrangement shown in FIG. 3, but in a non-assembled state.

FIG. 3 shows yet another embodiment of a waveguide interconnecting or transition arrangement 10B according to the invention, here comprising a two-section 90° waveguide twist, in an assembled state. Two waveguide twist sections $3B_1$,$3B_2$ are here arranged between a first waveguide flange 1B and a second waveguide flange 2B. The first and second waveguide flanges 1B,2B comprise two standard or non-standard rectangular waveguide flanges which are orthogonally polarized. The twist sections $3B_1$,$3B_2$ are arranged such that a two-section 90° twist formed and they are arranged to change the polarization of the connection or transition comprising two orthogonally polarized waveguides 11B,21B (FIG. 3A). Protruding elements, here pins, $35B_1$,$35B_2$,$35B_2'$ are arranged on side surfaces of the twist sections $3B_1$,$3B_2$ facing the waveguide flange sections 1B,2B and between the first and second twist sections $3B_1$,$3B_2$ allowing contactless connections to the, here, smooth waveguide flange sections 1B,2B and between the first and second twist sections $3B_1$,$3B_2$.

As in the embodiment described with reference to FIG. 1, the waveguide flanges or flange sections 1B,2B are identical except for the rotation angles around the waveguide axes. The waveguide flange sections 1B,2B are here just flat waveguide pieces, the thicknesses of which are mainly determined by the mechanical requirements for the waveguide flange sections or the plates to have a sufficient hardness for being flat.

FIG. 3A is a view in perspective of the transition or interconnecting arrangement of FIG. 3 in a disassembled or non-assembled state. The first waveguide flange 1B here comprises a standard or a non-standard rectangular waveguide 11B. The second waveguide flange 2B also comprises a standard or a non-standard waveguide flange with a waveguide 21B, but with a polarization which is orthogonal to the polarization of the first waveguide 11B. The interconnection waveguide twist sections $3B_1$,$3B_2$ are adapted to be disposed between the first and second waveguide flanges which here have smooth surfaces facing the outer side surfaces of the waveguide twist sections $3B_1$,$3B_2$. The first waveguide twist section $3B_1$ comprising waveguide section $31B_1$ comprises pins $35B_1$ on the side facing the first waveguide flange section 1B whereas the second twist section $3B_2$ comprising waveguide section $31B_2$ comprises pins $35B_2$ on both sides, i.e. on the side facing the second waveguide flange 2B and on the side facing the first waveguide twist section $3B_1$. Cavities (not indicated in FIG. 3A; reference is made to corresponding cavities in FIG. 1), but here also a cavities are provided on the second waveguide twist section $3B_2$, on the side thereof facing the first waveguide twist section $3B_1$, which here has a smooth surface on the side facing the second waveguide twist section $3B_2$. The length of the pins $35B_1$,$35B_2$ is about a quarter wavelength of the centre operation frequency of the arrangement, and in advantageous embodiments each twist section $3B_1$,$3B_2$ has a thickness of about a quarter wavelength of the centre operation frequency. The waveguides 11B,21B are orthogonal, the waveguide openings forming an angle of about 90° with each other, and the waveguide twist section waveguides $31B_1$,$31B_2$ form an angle of about 30° with each of the first and second waveguides 11B,21B and with each other, or alternatively e.g. an angle of about 20° with each other and an angle of about 35° with a respective waveguide section $3B_1$,$3B_2$. Other angles can also be used.

The periodic or quasi-periodic structures comprising a plurality of pins $35B_1$,$35B_2$ are as referred to above, arranged to surround the rectangular waveguide openings. Wings or metal rim sections or frame surfaces, or ridges, as discussed with reference to FIGS. 1,1A are here provided such that substantially rectangular metal wing or rib sections $33B_1$,$33B_2$ are provided centrally on the respective long, wide, sides of the waveguide $31B_1$,$31B_2$ openings and two narrow, curved edges are provided on the short or narrow sides of the waveguide openings. The height of the wing or rim sections $33B_1$,$33B_2$ and of the narrow curved edges is here substantially the same as the height of the protruding elements $35B_1$,$35B_2$ of the periodic or quasi-periodic structures. The long side wings or rim or ridge sections $33B_1$, $33B_2$ may e.g. have a width of about $\lambda/4$, $\lambda$ being the wavelength of the operating frequency in the waveguide structure (not shown to scale in FIG. 1 etc.), and serve the purpose of, together with the opposite smooth waveguide flanges 1B,2B and the smooth or flat side of the first twist section $3B_1$ respectively, forming impedance transformers transforming open circuits to short circuits to avoid leakage and reflections which may be created at the interfaces between the waveguide twist sections and the waveguide flanges 1B,2B and between the waveguide twist sections $3B_1$,$3B_2$ respectively.

In other respects the elements and the functioning are similar to that described with reference to FIGS. 1-1E, and similar elements bear similar reference signs which are indexed "B", and will therefore not be further discussed here.

Figure 3B:
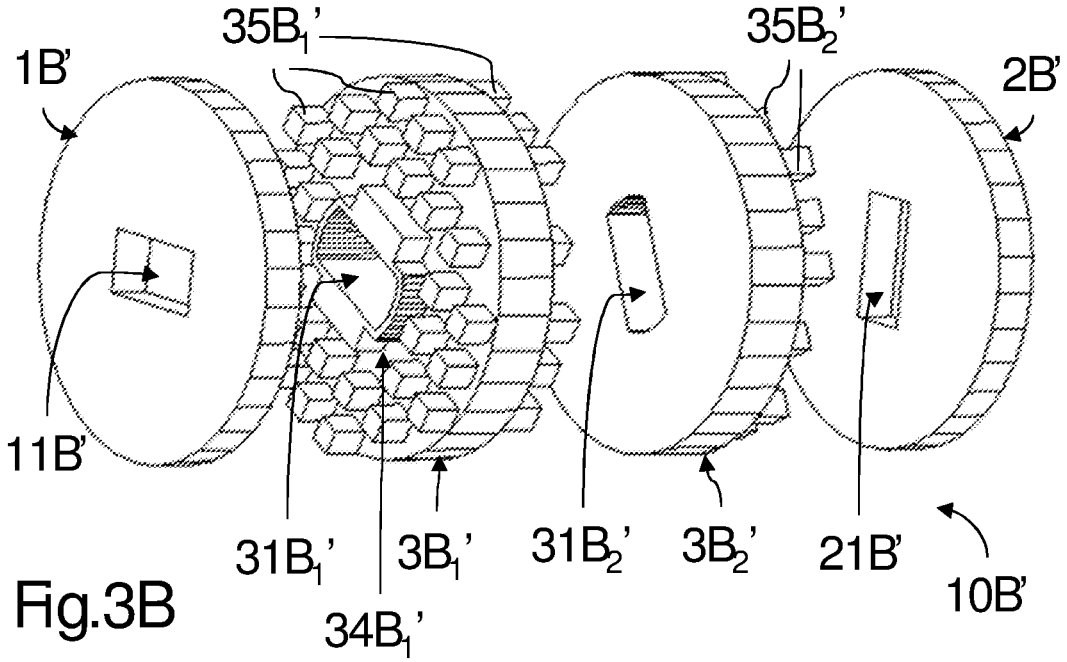
FIG. 3B shows an alternative embodiment of a transition arrangement comprising a two-section 90° twist.

FIG. 3B is a view in perspective of another embodiment of a waveguide interconnecting or transition arrangement 10B', here in a disassembled or non-assembled state, comprising a two-section 90° waveguide twist. Two waveguide twist sections 3B i',3$B_2$' are arranged between a first waveguide flange 1B' and a second waveguide flange 2B' similar to the embodiment shown in FIGS. 3,3A, with the only difference that it is the first waveguide twist section 3$B_1$' that comprises a periodic or quasi-periodic structure 35$B_1$' on both sides, whereas the second waveguide twist section 3$B_2$' comprises one flat or smooth side, which faces the pin structure 35$B_1$' on the first waveguide twist section 3$B_1$' and a periodic or quasi-periodic structure on the side facing the second waveguide flange section 2B'. Similar elements bear the same reference signs as corresponding elements in FIG. 3A but are provided with a prime ('), and will therefore not be further described herein.

Figure 4:
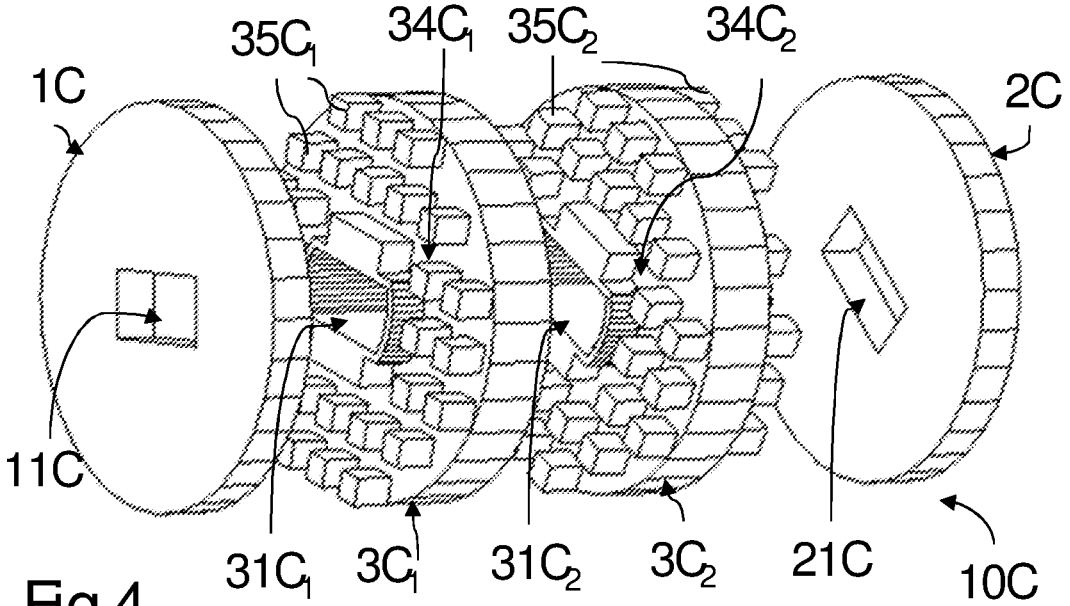
FIG. 4 is a view in perspective of an embodiment of a transition arrangement comprising a two-section 45° waveguide twist in a non-assembled state.

FIG. 4 is a view in perspective of still another embodiment of a waveguide interconnecting or transition arrangement 10C shown in a disassembled or non-assembled state and comprising a two-section 45° waveguide twist. Two waveguide twist sections 3$C_1$,3$C_2$ are arranged between a first waveguide flange 1C and a second waveguide flange 2C similar to the embodiment shown e.g. in FIGS. 3,3A, with the difference that the waveguides 11C,21C are rotated 45°, and the waveguide twist section waveguides 31$C_1$,31$C_2$ form an angle of about 15° with each of the first and second waveguides 11B,21B and with each other, or e.g. an angle of about 20° with each other and an angle of about 12.5° with a respective waveguide flange. Also other angles can be used. The twist sections 3$C_1$,3$C_2$ are thus arranged such that a three-section 45° twist is formed and they are arranged to change the polarization of the connection or transition comprising two waveguides 11C,21C rotated 45° with respect to one another, (see also FIG. 2,2A).

Similar elements bear the same reference signs as corresponding elements in FIG. 3A but are indexed "C", there functioning is the same and they will therefore not be further described herein. Also here it is the second waveguide flange twist section 3$C_2$ that is provided with a periodic or quasi-periodic structure 35$C_2$ on both sides, whereas the first waveguide twist section 3$C_1$ has a periodic or quasi-periodic structure 35$C_1$ on one side only. It should be clear that alternatively the first waveguide twist section 3$C_1$ may be provided with a pin structure or similar on both sides, and the second twist section 3$C_2$ not, similar to the embodiment described with reference to FIG. 3B. It should also be clear that all embodiments are applicable also for any other angle equal to or smaller than 90° between first and second waveguide flanges. Wing sections may be provided on the wide wall edges only, or on the narrow walls also. The wing sections may be of different shapes, e.g. as described with reference to the embodiment shown in FIG. 2A or FIG. 2B. Alternatively there are no wing sections at all, only the cavities 34$C_1$,34$C_2$ are indispensable.

Figure 5:
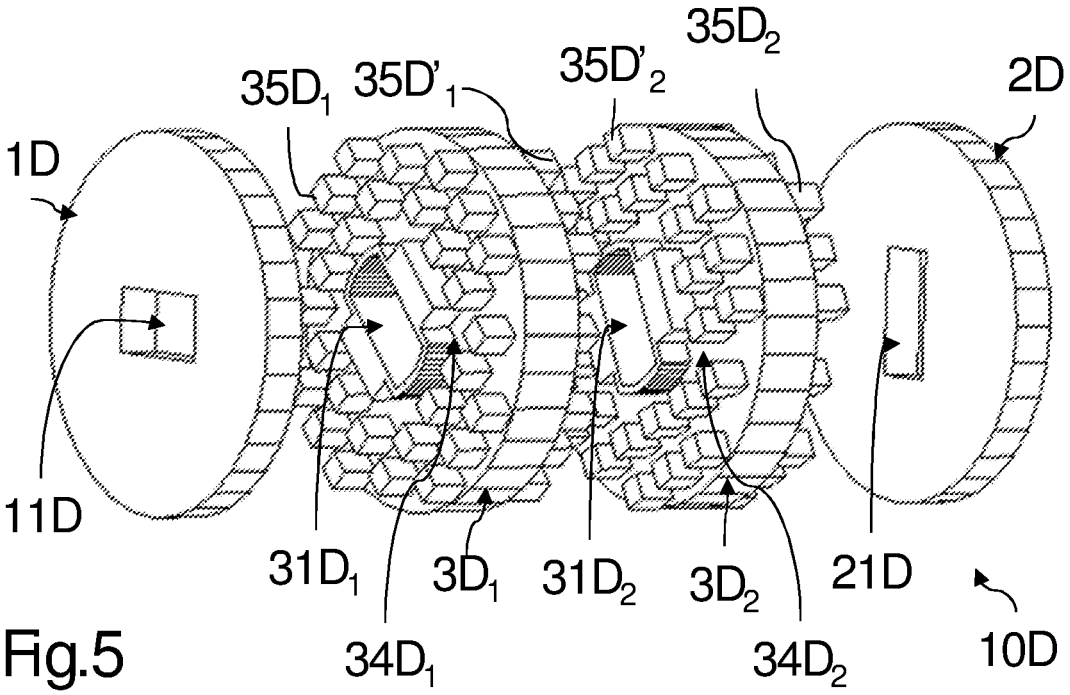
FIG. 5 is a view in perspective of an embodiment of a transition arrangement comprising a two-section 90° waveguide twist in a non-assembled state.

FIG. 5 is a view in perspective of an alternative embodiment of a waveguide interconnecting or transition arrangement 10D, here shown in a disassembled or non-assembled state, comprising a two-section 90° waveguide twist. Two waveguide twist sections 3$D_1$,3$D_2$ are arranged between a first waveguide flange 1D and a second waveguide flange 2D similar to the embodiment shown e.g. in FIGS. 3,3A, with the difference that the twist sections 3$D_1$,3$D_2$ are arranged such that a two-section 90° twist is formed and are arranged to change the polarization of the connection or transition comprising two waveguides 11D,21D which are orthogonal to one another, see also FIG. 3,3A and the description accompanying these Figures.

The twist section waveguides 31$D_1$,31$D_2$ form an angle of about 30° with the first and second waveguide 11D,21D respectively, and also form an angle of about 30° with each other, or alternatively they form an angle of about 35° with the first and the second waveguide 11D,21D respectively, and form an angle of about 20° with each other. Other selections of angles are also possible.

In the embodiment of FIG. 5 both the first and the second waveguide twist section 3$D_1$,3$D_2$ comprise a periodic or quasi-periodic structure 35D1, 35D2, here comprising pins, on one side of the respective twist section, and pins 35$D'_1$, 35$D'_2$, on the other side of the respective twist section, where 35$D'_1$ and 35$D'_2$ are facing each other. The periodic or quasi-periodic structure 35131,35D2 on those sides of the first and second twist sections 3$D_1$,3$D_2$ which are arranged to face the first and the second waveguide flange 1D,2D comprise full-height pins having a length of about a quarter wavelength of the operation frequency as also described above with reference to the preceding embodiments in general, and periodic or quasi-periodic structures 35$D'_1$, 35$D'_2$ on the other sides of the first and second twist sections 3$D_1$,3$D_2$ which are arranged to face to each other comprising half-height pins having a length of about an eighth wavelength of the operation frequency, and to the embodiment of FIG. 3,3A in particular, here comprising wing sections on the wide side of the waveguide openings, between which and the pin structure cavities 341$D_1$,34$D_2$ are provided, which will not be further described here since the same considerations apply as already described e.g. with reference to FIGS. 1, 1B . . . 3,3A. The first gap waveguide twist section 3$D_1$ is connectable with the second gap waveguide twist section 3$D_2$ with half-height pins on the side of the twist section 3$D_2$ facing the twist section 3$D_1$ and half-height pins on the side of the twist section 3$D_2$ facing the standard or non-standard waveguide flange 2D. The waveguide 31$D_2$ in twist section 3$D_2$ is rotated relative to the waveguide 31$D_1$ in twist section 3$D_1$ with an angle (here e.g. about 30°, but it could also be other angles as discussed above) in order to rotate the polarization from the first flange 1D to the second flange 2D with a minimum reflection between them.

Also other periodic structures may be applied to a waveguide interconnecting or transition arrangement, or cavity gap waveguide twist, according to the present invention as well as wings of any appropriate shape and dimensions may be applied or not along the wide edges of the waveguides, and also optionally along the narrow waveguide edges.

Figure 6:
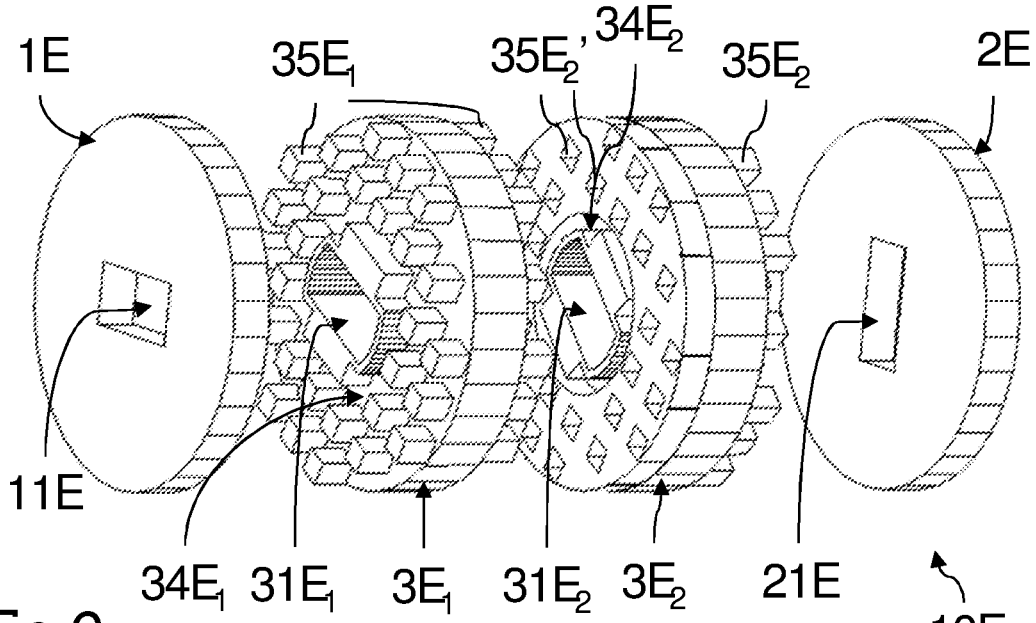
FIG. 6 is a view in perspective of still another embodiment of a transition arrangement comprising a two-section 45° waveguide twist in a non-assembled state having an alternative pin structure.

FIG. 6 shows an example of a waveguide interconnecting or transition arrangement 10E comprising an alternative pin structure, here shown in a disassembled or non-assembled state, and comprising a two-section 90° waveguide twist. The periodic or quasi-periodic structure of the waveguide twist 10E is based on a sliding symmetrical geometry with pins on one, here the first, twist section or plate 3$E_1$ and holes on the opposite, here the second, twist section or plate 3$E_1$. A standard or non-standard waveguide 11E in a flange 1E is thus connected with a sliding symmetrically geometrical first twist section 3$E_1$ with for example pins 35$E_1$ on the side facing flange 1E and pins 35$E_1$ on the other side facing the second twist section 3$E_2$, which second twist section 3$E_2$ instead is provided with geometrically correspondingly arranged holes 35$E_2$'. The waveguide 31$E_1$ is rotated with an angle, here e.g. 20° or 30°, relative to the waveguide 11E. The first gap waveguide twist section 3$E_1$ comprises pins 35$E_1$ on the side facing the waveguide flange 1E and pins 35$E_1$ on the side facing the second twist section 3$E_2$ with corresponding holes. Then, the first gap twist section 3$E_1$ is connected with the second gap twist section 3$E_2$ with holes 35$E_2$' on the side of the section 3$E_2$ facing the first twist section 3$E_1$. The second twist section 3$E_2$ comprises pins 35$E_2$ on the side of the section facing the standard or non-standard waveguide flange 2E. Elements similar to, and described with reference to preceding embodiments, e.g. FIG. 1,1A,3 etc. bear the same reference signs, but are indexed "E", and they will not be further discussed here. Particularly, as far as the cavities 34$E_1$, 34$E_2$ are concerned it should be clear that the same considerations apply as those discussed earlier as far as functioning, location and dimensions are concerned, and the holes 35$E_2$' are disposed in an annular section surrounding the waveguide opening and, here thus having a circular recess such that a cavity 34$E_2$ is provided between the waveguide edges, here with wings on the wide edges, and the annular section. The waveguide 31$E_2$ in second twist section 3$E_2$ is rotated relative to the waveguide 31$E_1$ in the first twist section 3$E_1$ with an angle, here about 35° or 30° as referred to above in order to rotate the polarization from flange 1E to flange 2E with a minimum reflection between them. It should be clear that the rotation angles between sections can be different as also discussed above as long as the total twist angle is 90°, for a 90° twist. Also other total twist angles smaller than or equal to 90° are also here possible.

Figure 7:
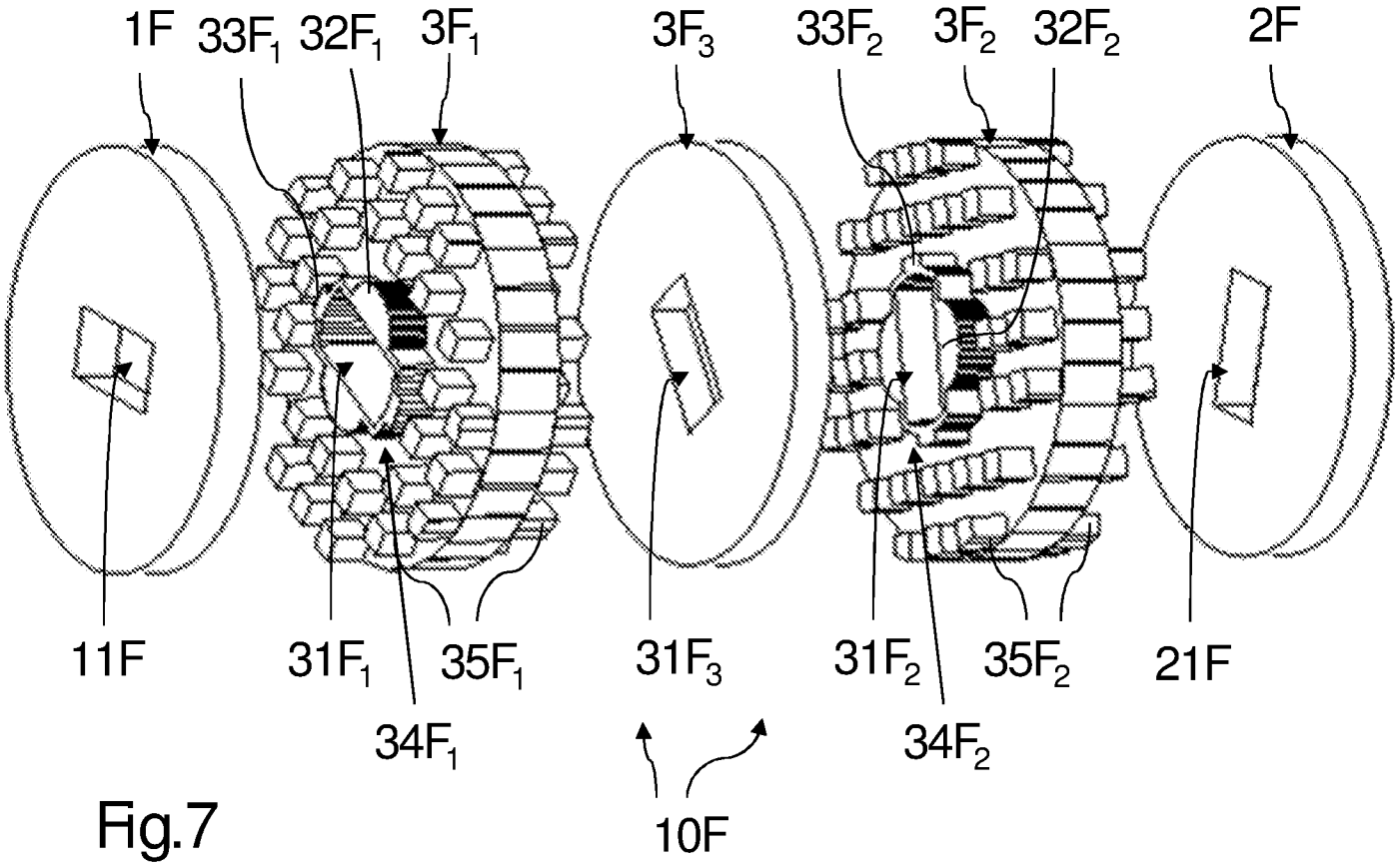
FIG. 7 is a view in perspective of an embodiment of transition arrangement comprising a three-section 90° waveguide twist in a non-assembled state.

FIG. 7 shows still another embodiment of a waveguide interconnecting or transition arrangement 10F comprising an alternative pin structure, here shown in a disassembled or non-assembled state, and comprising a three-section 90° waveguide twist. A standard or non-standard waveguide 11F in a flange 1F is connected with a first gap waveguide twist section 3$F_1$ provided with pins 35$F_1$ on both sides of the twist section 3$F_1$, i.e. on the side facing the first flange section 1F as well as on the side facing a third, intermediate, twist section 3$F_3$. The waveguide 31$F_1$ of the first twist section 3$F_1$ is rotated with an angle relative to the waveguide 11F. Then, the first gap waveguide twist section 3$F_1$ is connected with a flat plate section, the third twist section, 3$F_3$ with a waveguide 31$F_3$ in it. The third twist section waveguide 31$F_3$ is rotated an angle relative to waveguide 31$F_1$ in the first twist section 3$F_1$. Then, the third twist section 3$F_3$ comprising a flat plate is connected with a second gap waveguide twist section 3$F_2$ with pins 35$F_2$ on both sides, i.e. on the side of the second twist section 3$F_2$ facing the third twist section 3$F_3$ and on the side facing the second standard or non-standard waveguide flange 2F. The waveguide 31$F_2$ in the second twist section 3$F_2$ is also rotated relative to the waveguide 31$F_3$ in the third section 3$F_3$ with an angle in order to rotate the polarization from flange 1F to flange 2F with a minimum reflection between them. The rotation angle between two adjacent twist sections is here 20° and the angle between a twist section and a flange section is about 25°. Alternatively the angle between any two adjacent sections is about 22.5°. The invention is however not limited to any specific angles as long as the sum of the angles is 90° if a 90° twist is desired. A three-section twist as described herein can also be provided for any other total twist angle less than 90°. With three sections the wide band performance of the arrangement can be enhanced even more.

The arrangement is also advantageous in that the first and second twist sections are substantially equal, which is from a manufacturing point of view. Also for a three-section arrangement it is of course possible to have one, or two, twist sections with holes on one side and pins or similar on the other, cf. FIG. 6.

In this embodiment there are wings 32$F_1$,32$F_2$ on the wide as well as on the short waveguide edges, see e.g. FIG. 2A, which is advantageous as discussed above, and it comprises a so called double-wing arrangement. It should be clear that wings could be provided only on the wide edges, or that the shapes of the wings can be different, or it is also possible to have no wings at all, as long as there are cavities between the waveguide edges and the periodic structure.

The waveguide flanges 1,2,1A,2A etc. may e.g. be standard waveguide flanges, e.g. V-band flanges, E-band flanges, WR15 flanges, or any other standard or non-standard waveguide flanges. They may comprise alignment pin holes (not shown in the Figs. since they are not of importance for the functioning of the inventive concept) for reception of alignment pins, and screw holes adapted for reception of fastening screws. The arrangement according to the invention may be releasably or fixedly connected to the standard waveguide flanges. In some embodiments interconnecting elements in the form of screws with heads with magnets, magnetic screw heads, or magnetic elements on the screw heads, may be used as discussed in PCT/SE2016/050387 filed on May 3, 2016 by the same Applicant as the present application which herewith is incorporated herein by reference.

The invention also covers waveguide structures comprising more than one waveguide twist as described in the foregoing.

Figure 8:
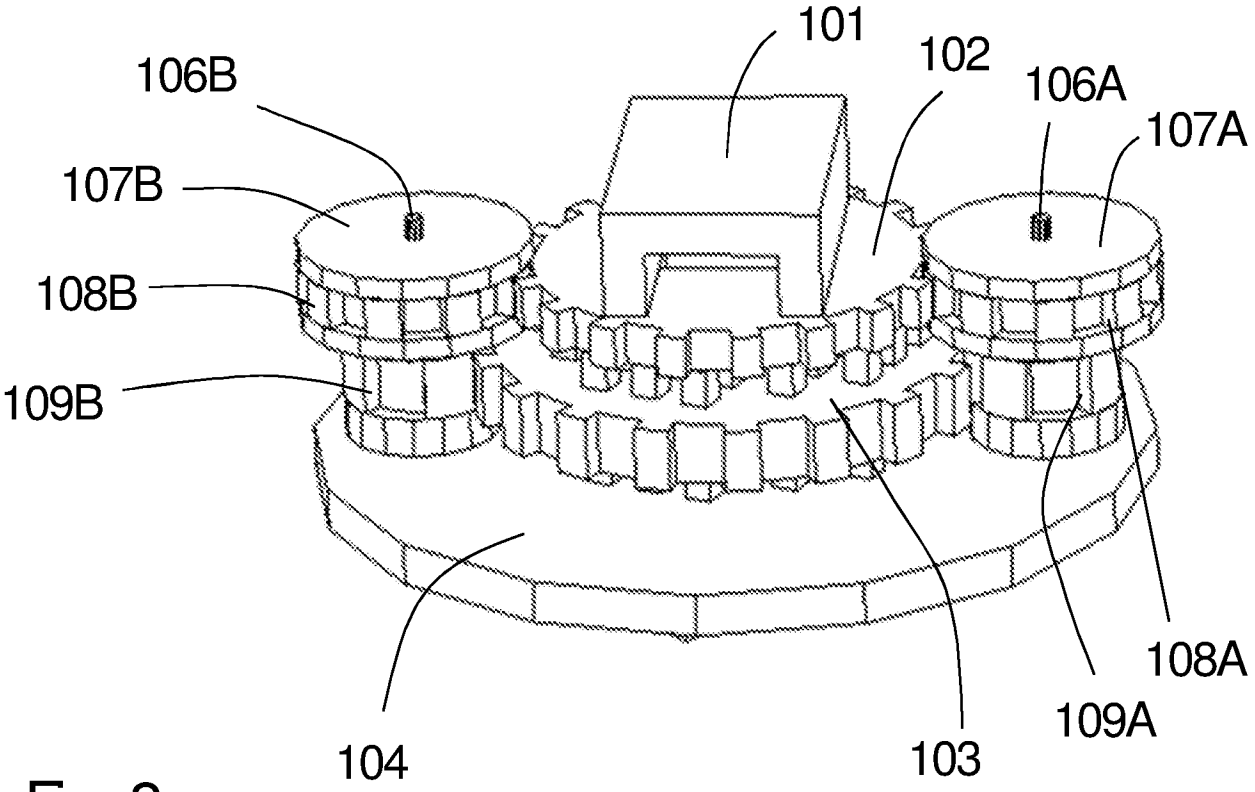
FIG. 8 is a view in perspective of a 90° rotary joint according to one embodiment of the present invention.

FIG. 8 shows an exemplary 90° scanning rotary joint according to one embodiment of the invention based on a one-step 45° twist e.g. as shown in FIG. 2, where a rectangular waveguide 101 is fastened on a, here, upper, plate 102 with a rectangular waveguide 101, and, beneath which a non-contact pin plate with a rectangular waveguide 103 is provided, beneath which in turn a plate 104 with a rectangular waveguide opening is provided. In the initial stage, the polarizations of waveguides 102, 103 and 104 are aligned each other (with the same polarization). Gear sets 107A, 107B are made by rotary axes 106A and 106B and comprise gears with different radii so that when the waveguide 101 is rotated, relative to plate 104, gear sets 107A and 107B will rotate, and the plates 102 and 103 will rotate with different rotational speeds, the upper plate 10 with the waveguide 101 has a smaller diameter than the intermediate plate with the waveguide 103, which in turn has a smaller diameter than the bottom plate 104 with the waveguide 105.

A rotary joint according to the present invention comprises a transition arrangement comprising a waveguide twist as described in any one of the embodiments described in this application, with one or more waveguide twist sections, and a number of gear sets 107A,107B with engagement elements, here teeth, rotatable around a respective rotary axis 106A,106B. The inventive concept is applicable also for other types of gear sets, and/or other types of engagement elements.

The gear sets 107A,107B are rotatable round the respective axes 106A,106B which here are connected to a plate 104 comprising an e.g. fixed waveguide structure with a waveguide 105. A rotatable waveguide structure with a waveguide 101 is fixed to a gear plate 102 provided with engagement elements, e.g. gear teeth, thus forming another waveguide structure which is adapted for engagement with a respective first engagement element or tooth section 108A, 108B of the gear sets 107A,107B. Between these waveguide structures with waveguides 105,101 a rotatable waveguide twist section arrangement with, in this embodiment, one waveguide 103 twist section is arranged which is circular and peripherally provided with engagement elements, e.g. teeth, on for engagement with respective second engagement or tooth sections 109A,109B of the gear sets 107A, 107B such that the rotatable waveguide structure and the rotatable waveguide 103 twist section will rotate with different speeds depending on with which of the gear set engagement or tooth sections 108A,108B;109A,109B they engage.

The angular speed of plate 103 here e.g. is half of the angular speed of the plate 102 so when the waveguide 102 has rotated with +45°, the waveguide 103 has rotated exactly the half of +45°, e.g., +22.5°, all relative to the waveguide 104. Then, this corresponds to the embodiment shown in FIG. 2. When the waveguide 102 has rotated with −45°, the waveguide 103 has rotated exactly the half of −45°, e.g., −22.5°, all relative to the waveguide 104. Then, this also corresponds to the embodiment shown in FIG. 2. Therefore, a 90° scanning rotary joint is realized.

Figure 8A:
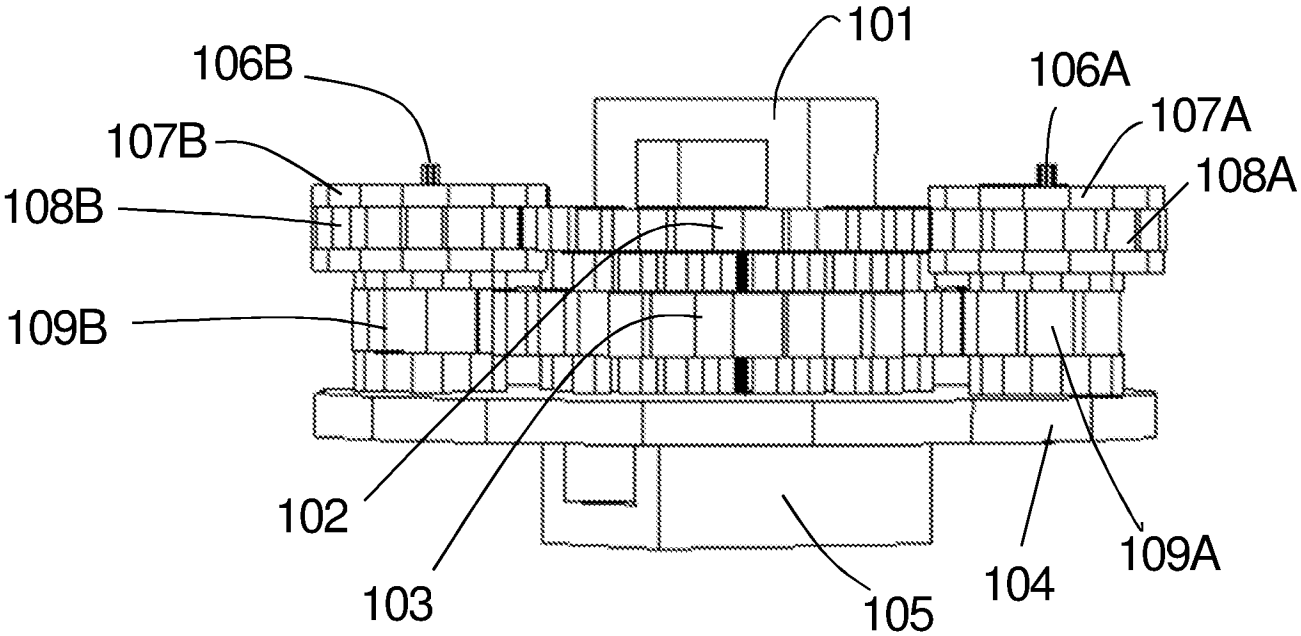
FIG. 8A is a side view of the rotary joint of FIG. 8.
Figure 8B:
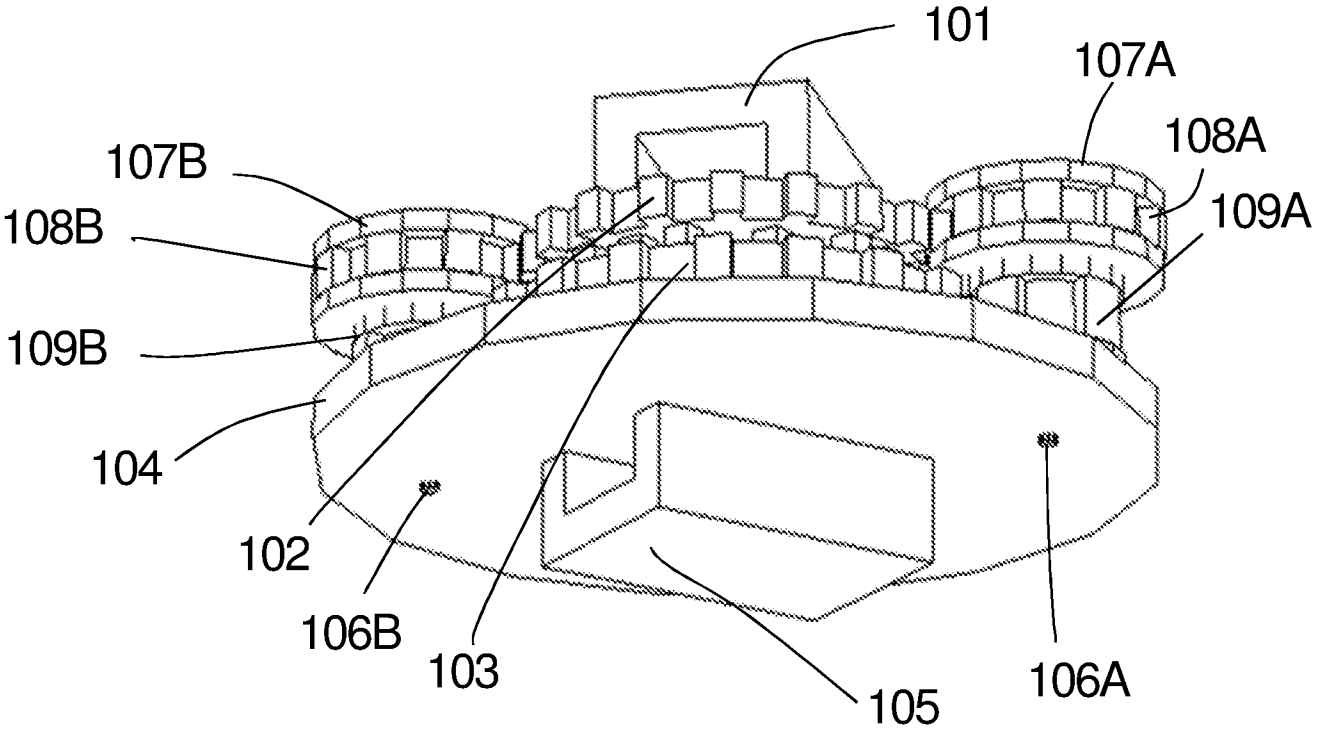
FIG. 8B is a view in perspective from below of the rotary joint of FIG. 8.
Figure 8C:
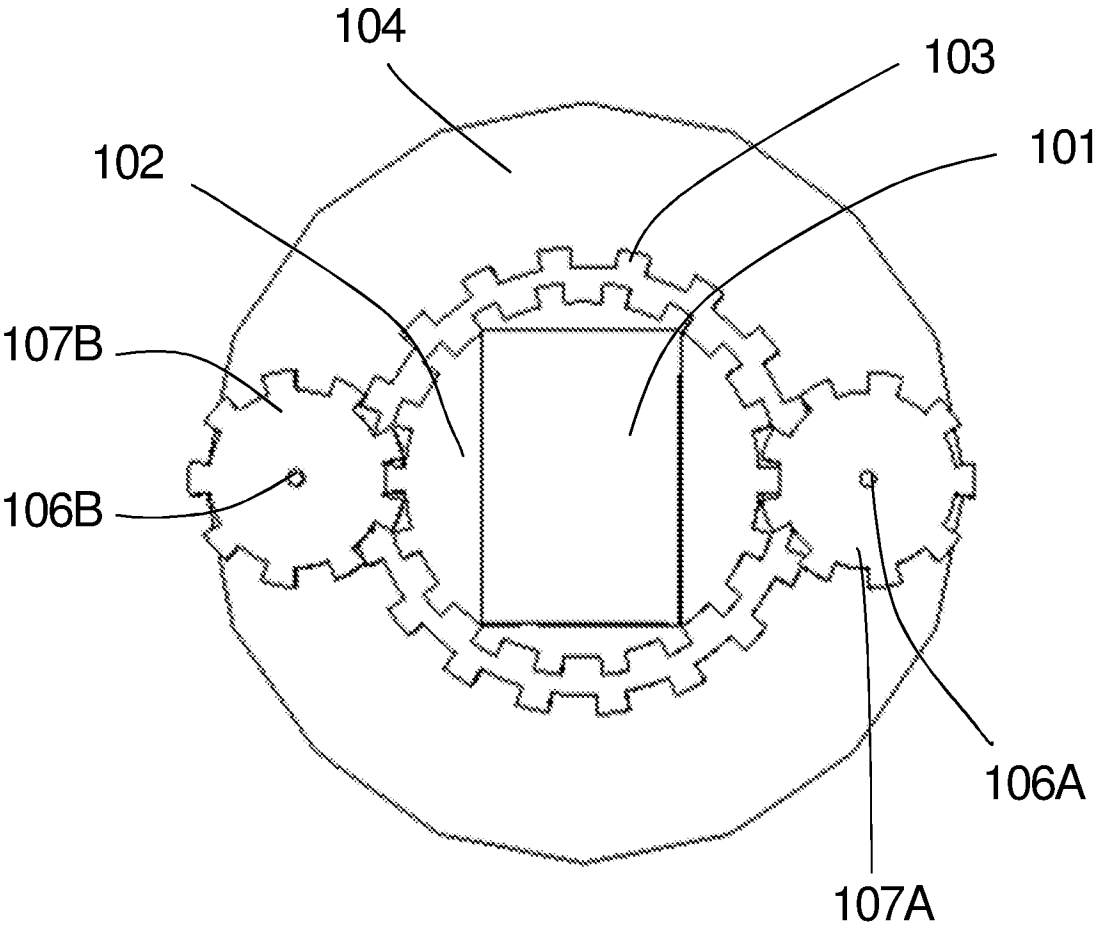
FIG. 8C is a top view of the rotary joint of FIG. 8.
Figure 8D:
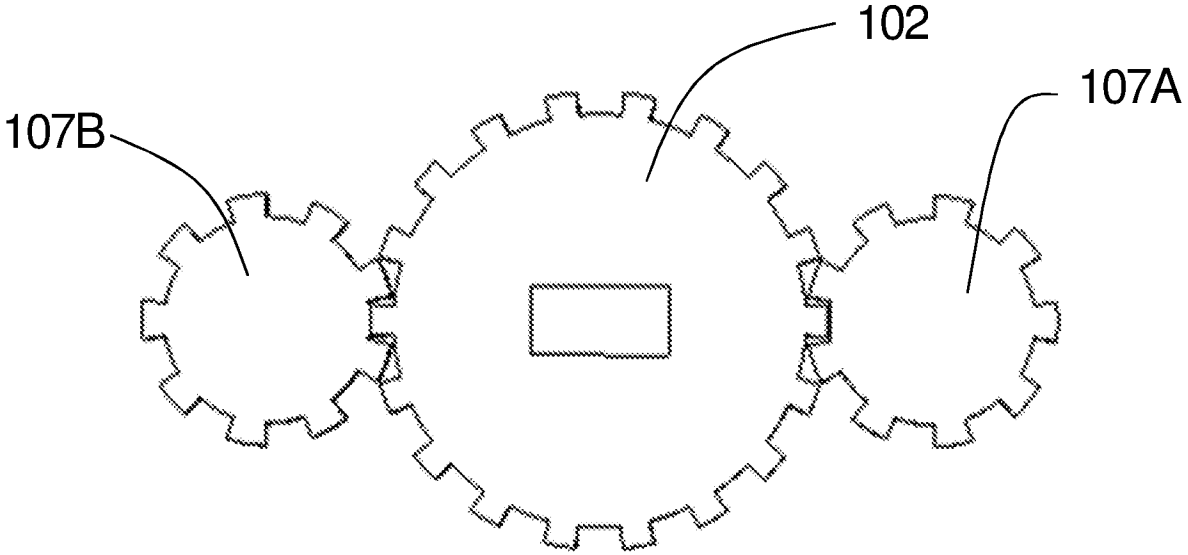
FIG. 8D is a view of the rotary joint of FIG. 8 showing only the plate with the rectangular waveguide.
Figure 8E:
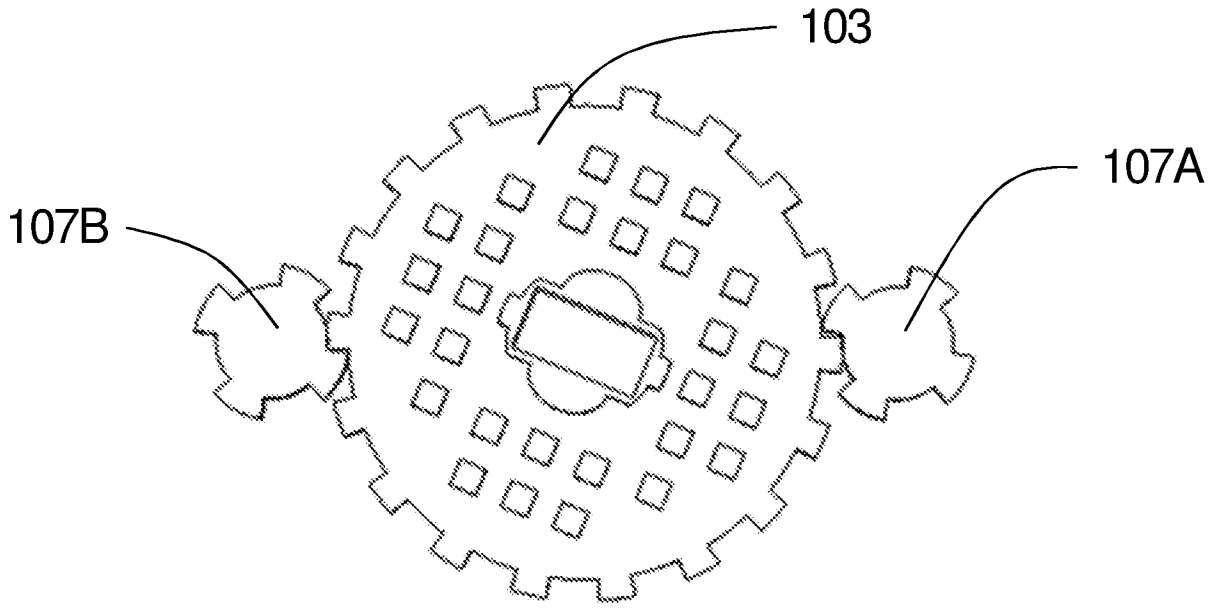
FIG. 8E is a schematic view of the rotary joint of FIG. 8, showing only a second plate with an exemplary pin structure.

FIG. 8A is a side view of a 90 degree rotary joint as shown in FIG. 8, where a rectangular waveguide 105 forms a fixed waveguide. FIGS. 8B-8E show different views of a rotary joint according to the present invention.

The invention is not limited to a 90° scanning rotary joint. In a similar way, an 180° rotary joint can be easily made. The invention is further not limited to a one-section rotary joint. In a similar way, a three-section 180° rotary joint can be easily made. The invention is also not limited to the gear sets described above. It can have other types of gear sets or even other rotating schemes. The essence of the invention is using non-contact waveguide sections to make a rotatable configuration, where the impedance match is satisfactory and there is no leakage of wave propagation. It may also comprise more than one twist section, e.g. two, three, or more.

It should be clear that the invention is not limited to embodiments with three or fewer waveguide twist sections, even if such embodiments are extremely advantageous. The inventive concept also covers embodiments with more than three, e.g. four or even more, twist sections.

A twist section according to the invention particularly is solid and made in one piece in order not to influence the signal flow. It may e.g. be made by moulding, casting, ablation, material assembling, e.g. micro-assembling and cutting is another method. In other embodiments it comprises more than one section or elements joined in any appropriate manner.

Interconnection of twist sections and waveguide flange sections may in some embodiments be achieved by means of a snap-on operation. If screws are used, they can e.g. be applied or introduced into screw holes of the waveguide flanges on beforehand. The inventive concept is however not limited to any particular interconnection technique or to the use of any particular elements.

In some embodiments different heights are used for the sets of pins or protruding elements or corrugations of the twist sections, or flange sections. The lengths or heights of the pins or protruding elements, or corrugations, may also vary within the respective sets (not shown), as long as the total length of one another facing, or oppositely disposed, pins, protruding elements or corrugations corresponds to a length required for the desired stop band. Such different arrangements of protruding elements are disclosed in the European patent application "Waveguide and transmission lines in gaps between parallel conducting surfaces", EP15186666.2, filed on 24 Sep. 2015 by the same Applicant, the content of which herewith is incorporated herein by reference, and which shows a microwave device which comprises two conducting layers arranged with a gap there between, wherein each of the layer comprises a set of complementary protruding elements, arranged in a periodic or quasi-periodic pattern and connected thereto, and which sets in combination for a texture for stopping wave propagation in a frequency band of operation in other directions than along intended wave guiding paths. When the lengths of the protruding elements are the same, and the full length of the periodic or quasi-periodic structure, or the texture, being formed by two protruding elements arranged on each a conducting layer, the length of a protruding element hence corresponding to half the length of the full-length of the protruding elements of the texture.

Generally, throughout the application, the length of a full-length protruding element is approximately between $\lambda/4$ and $\lambda/2$, and the height of a so called half-length element, is substantially between $\lambda/8$ and $\lambda/4$, $\lambda$, being the wavelength in free space or a dielectric media.

The air gaps between different sections are smaller than $\lambda/4$, or about 10-20 μm or up to about 100 μm for E-band.

A particular advantage with the use of half-height protruding elements is that only one type of twist section is needed instead of two different types involved if it is a two-, or three-section arrangement.

It should also be clear that the pattern of the textured surface, of the protruding elements forming the periodic or quasi-periodic structure, can be different as discussed above. It may also e.g. comprise a number of protruding elements comprising a number of grooves and ridges e.g. two or three, or in some cases more, elliptically disposed around the waveguide opening on a conductive surface to form a periodic or quasi-periodic structure on one or two sides of a twist section. The depth of such grooves is about $\lambda/4$ for a full-height implementation for interconnection with a waveguide flange or a twist section with a smooth surface, and about $\lambda/8$ for half-height implementations as described with reference to FIG. 7. For half-height implementations both interconnecting sections are provided with half-height protruding elements of any kind, or, with protruding elements of such lengths as to, in a cooperating pair, form a full-height protruding element, but with a gap between them. When pins are used for providing a periodic or quasi-periodic structure, the pins can be thick or thin. Thick pins are preferable from a manufacturing point of view. A larger pin thickness to pin height ratio makes the production easier. However, standard flanges have a fixed size, so that there is a limited space to fit the pins in, and each row of pins introduces an attenuation for the waves preventing them from leaking out. Therefore, thin pins are preferable for a better performance of the twist, that is, for having less leakage. The inventive concept covers the use of thick as well as thin pins, or other protruding elements which are thick or thin, of different cross-sectional shapes.

As also mentioned earlier the edge (or rim or ridge) around the waveguide openings of the twist sections play a role for the electrical performance and the dimensions therefore should be selected appropriately. Also fabrication aspects need to be considered. E. Pucci, P.-S. Kildal, "Contactless Non-Leaking waveguide flange Realized by Bed of Nails for millimeter wave Applications", $6^{th}$ European Conference on Antennas and Propagation (EUCAP), pp. 3533-3536, Prague, March 2012, discloses the use of a ridge around the waveguide opening. This ridge has the same height as the pins have, and is much thicker along the wide side of the waveguide opening, and is referred to as an "Impedance Transformer". This thickness is about λ/4, and it transforms an open circuit in a short circuit at the waveguide opening, in such way that the waves "see" a metal wall or electric contact even if physically there is a gap between the flanges where the waves could come in. A similar textured structure is used in some embodiments e.g. with a difference that there is one more, shorter, row of pins outside the outermost row on the wide sides of the waveguide opening and that the walls of the short edges (rims or ridges) are somewhat thicker. In advantageous embodiments at least the edges along the wide side of the waveguide are provided with wings as also discussed above.

It has been realized that the long edge or rim is also important for stopping waves from propagating through the gap, and even makes it possible to reduce the number of rows of pins (or more generally protruding elements) needed for the design to two or even to only one even if the invention is not limited thereto. The rectangular edge or rim or around the waveguide opening is modified in order to cover a larger frequency band, e.g. in some implementations the whole frequency band from 50 GHz to 75 GHz or for the whole E-band of 70-90 GHz, although the present invention of course not is limited thereto, but it may be adapted to cover any appropriate or desired frequency band. Advantageously the rims or ridges on the narrow or short sides of the waveguide have a sufficient thickness to allow easy manufacture, e.g. between about 200-400 μm, preferably less than 400 μm. The rims or ridges particularly along the wide or long sides of the waveguide opening may be divided into different sections, a central wing, rim or ridge section, or a platform, which has a thickness of about V4, and outer narrower rim or ridge sections with a smaller thickness. Thus, the central wing or platform section does not have to extend all along the full length of the wide side of the waveguide opening.

The length or extension of the wing or the central rim or ridge section can be optimized to give a good performance in terms of leakage within the frequency band of interest, in some embodiments e.g. 50-75 or 70-90 GHz. There is a relation between the thickness of the rim or ridge along the narrow side of the waveguide opening and the length of the ridge or platform. The larger the thickness of the short side rim or ridge, the shorter the length of the wing or the central ridge or platform section.

The invention claimed is:

1. A transition arrangement for interconnection of waveguide structures or waveguide flanges for forming a waveguide twist, wherein a waveguide twist section arrangement comprising a number of waveguide twist sections is arranged between the waveguide structures or waveguide flanges for rotating a polarization of waves or signals twisted or forming an angle with an adjacent waveguide flange and/or another adjacent waveguide twist section with respective waveguide openings, wherein further the, or each, twist section and/or waveguide flange on at least one side thereof comprises a surface of a conductive material with a periodic or quasi-periodic structure formed by a number of protruding elements arranged or designed to allow the waves to pass across a gap between the waveguide twist section and the waveguide structure or the waveguide flange and/or between the number of waveguide twist sections and another waveguide twist section in a desired direction or waveguide paths, at least in an intended frequency band of operation, and to stop propagation of waves in the gap in other directions, such that a connection or connections between the waveguide structures or waveguide flanges and the twist section arrangement is/are contactless, requiring no conductive contact, the surface or surfaces formed by the periodically or quasi-periodically arranged protruding elements not being in direct mechanical contact with an opposite, interconnecting, waveguide structure or waveguide flange or waveguide twist section, wherein the transition arrangement is arranged to form a waveguide twist with an arbitrary rotation angle smaller than or equal to +/−180°, and wherein a respective cavity is provided between each waveguide opening in the number of waveguide twist sections and/or waveguide structure or waveguide flange and the surrounding periodic or quasi-periodic structure of the respective waveguide twist section and/or waveguide structure or waveguide flange, hence introducing compensating capacitances to compensate for inductances introduced at the twist section interfaces.

2. The transition arrangement according to claim 1, wherein the transition arrangement is arranged to form the waveguide twist with an arbitrary rotation angle smaller than or equal to +/−90°.

3. The transition arrangement according to claim 1, wherein the, or each, gap is smaller than λ/4, λ being a wavelength in a media surrounding the protruding elements, wherein the media is free space or a dielectric media.

4. The transition arrangement according to claim 1, wherein metal rim, ridge or wing, sections are provided at least on wide or long sides of the waveguide opening of a waveguide twist section forming wide side wing sections.

5. The transition arrangement according to claim 4 wherein the, or each, metal rim, ridge or wing section has a height substantially corresponding to the height of surrounding protruding elements of a periodic or quasi-periodic structure.

6. The transition arrangement according to claim 4, wherein the wide side wing sections are provided on the waveguide opening wide sides, and wherein the wide side wing sections are substantially rectangular, triangular, or rounded, or comprise a central section with a wing radius of about a quarter wavelength at a center operation frequency which on opposite ends is surrounded by two outer wing sections which are rectangular or have a radius of about an eighth of the wavelength at the center operation frequency.

7. The transition arrangement according to claim 4, wherein narrow side wing sections are provided on the waveguide opening narrow sides, and wherein the narrow side wing sections are substantially rectangular, triangular or rounded, or comprise a central rounded section or similar, or a narrow edge.

8. The transition arrangement according to claim 4, wherein the, or each, cavity is formed between the wing sections and the surrounding protruding elements of a periodic or quasi-periodic structure, the cavity having dimensions of about one λ, λ being the wavelength at a center operation frequency or more in the direction of the wide side of the waveguide opening or the wide side waveguide wall and about one λ, λ being the wavelength at the center operation frequency or less in the direction of the narrow side of the waveguide opening or the narrow side waveguide wall.

9. The transition arrangement according to claim 4, wherein dimensions of said wing sections are selected with respect to one another, and wherein also the pattern of the periodic or quasi-periodic structure and the wing section dimensions are selected with respect to one another in order to optimize electrical performance while considering manufacture requirements as to a required wing section thickness.

10. The transition arrangement according to claim 1, wherein metal rim, ridge or wing sections are provided at least on narrow or short sides of the waveguide opening of a waveguide twist section forming narrow side wing sections.

11. The transition arrangement according to claim 1, wherein a thickness of the, or each, waveguide twist section substantially is given by a length of protruding elements provided on the twist section, or enough thickness to provide a sufficient hardness for a twist section with protruding elements on both sides, or about $\lambda/4$ plus the thickness of the plate, $\lambda$ being a wavelength of a wave passing through the transition arrangement, or enough thickness to provide a sufficient hardness for a twist section with protruding elements on one side only.

12. The transition arrangement according to claim 1, wherein the at least one waveguide twist section comprises alignment pin holes substantially symmetrically disposed around, and at a distance from, the surface formed by periodically or quasi-periodically arranged protruding elements, and wherein the transition arrangement is arranged to be aligned with respect to an interconnecting waveguide twist section or waveguide flange by means of alignment pins introduced into the alignment pin holes of the waveguide twist section and into cooperating pin holes in the interconnecting waveguide twist section or waveguide flange.

13. The transition arrangement according to claim 1, wherein the waveguide twist section or sections is/are adapted to be fixedly or releasably connectable to the waveguide flange and/or another waveguide twist section.

14. The transition arrangement according to claim 1, wherein the, or each, waveguide twist section is/are adapted to be releasably connectable to, or interposed between, two waveguide structures or waveguide flanges, and wherein it/they is/are slidably arranged on alignment pins, and/or that at least two of the waveguide twist section(s) and waveguide flanges comprise fastening elements, or clamping elements or clip, snap-on, elements with magnetic elements fixedly or releasably connectable thereto.

15. The transition arrangement according to claim 1, wherein the periodic or quasi-periodic structure or structures comprises the plurality of protruding elements having a square-shaped, rectangular, oval or circular cross-section, or comprises cross-section, or a corrugated surface or any other periodic or quasi-periodic structure.

16. The transition arrangement according to claim 1, wherein the protruding elements have dimensions and are arranged in a pattern adapted for a specific, desired frequency band.

17. The transition arrangement according to claim 1, wherein protruding elements of the periodic or quasi-periodic structure are arranged in rows around the waveguide opening.

18. The transition arrangement according to claim 1, wherein protruding elements on one another facing adjacent waveguide twist sections and/or side surfaces of the waveguide twist section and the waveguide structure or the waveguide flange surfaces are arranged to be complementary, such that each protruding element of a first set of protruding elements on one of the sides faces a protruding element of a second set of protruding elements on the other side which the protruding element faces, each of the said elements having such a height or length that the total height or length of the element and the complementary element thereof corresponds to a full length or height of the elements of a periodic or quasi-periodic structure needed to stop propagation of waves inside the gap between the waveguide twist section and the waveguide flange or between two waveguide twist sections in any direction is provided, whereas waves are allowed to pass across the gap from a waveguide opening in one waveguide twist section or flange surface to a waveguide opening in the other twist section or flange element, at least in the intended frequency band, the lengths or heights of the protruding elements of the first and second sets either being the same, each having substantially half the total length required to form a desired stop band, or the lengths or heights of the protruding elements of the first and second sets, and/or within the first and second sets respectively, are different, the total length of two one another facing protruding elements substantially corresponding to the total length required to form a desired stop band, or wherein the protruding elements on two one another facing sides are arranged in an offset position with respect to one another.

19. The transition arrangement according to claim 1, wherein the transition arrangement comprises a one-section waveguide twist with one waveguide twist section arranged between a first waveguide flange or waveguide structure and a second waveguide flange or waveguide structure, the first and second waveguides of the first and second waveguide flanges or waveguide structures, the waveguide of the twist section forming an angle with each of the said first and second waveguides such that the sum of said angles correspond to the waveguide twist angle.

20. The transition arrangement according to claim 19, wherein the transition arrangement comprises a one-section 90° waveguide twist, the first and second waveguides of the first and second waveguide flanges or waveguide structures being orthogonally polarized, the waveguide openings of which forming an angle of about 90° with each other, and the waveguide twist section waveguide forming an angle of about +/−45° with the first and the second waveguides respectively.

21. The transition arrangement according to claim 19, wherein the transition arrangement comprises a one-section 45° waveguide twist, the first and second waveguides of the first and second waveguide flanges or waveguide structures, the waveguide openings of which forming an angle of about 45° with each other, and the waveguide twist section waveguide forming an angle of about +/−22.5° with the first and the second waveguides respectively.

22. The transition arrangement according to claim 1, wherein the transition arrangement comprises a two-section waveguide twist with two waveguide twist sections arranged between a first waveguide flange or waveguide structure and a second waveguide flange or waveguide structure, the first and second waveguides of the first and second waveguide flanges or waveguide structures, the waveguides of the twist sections forming angles with each other and with either one of the said first and second waveguides respectively such that the sum of said angles correspond to the waveguide twist angle.

23. The transition arrangement according to claim 22, wherein one of the twist sections comprises protruding elements on both sides and wherein the other waveguide twist section comprises protruding elements only on the side facing a waveguide flange or waveguide structure.

24. The transition arrangement according to claim 22, wherein both the twist sections comprises protruding elements on both sides and wherein the protruding elements on those sides of the waveguide twist sections that face each other are shorter than the protruding elements provided on the sides facing the waveguide flanges or waveguide structures, and ha comprises protruding elements only on the side facing a waveguide flange or waveguide structure, and form complementary protruding elements such that the height of two complementary protruding elements substantially correspond to the height of a protruding element facing a waveguide flange or waveguide structure.

25. The transition arrangement according to claim 22, wherein one of the twist sections comprises protruding elements on both sides and wherein the other waveguide twist section comprises protruding elements only on the side facing a waveguide flange or waveguide structure, and a plate element with recesses adapted to correspond to the location and shape of protruding elements provided on the other facing waveguide twist section and with a central recess surrounding the waveguide opening such that the cavity is formed between inner walls of said central recess and the waveguide wall or wing sections.

26. The transition arrangement according to claim 1 wherein the transition arrangement comprises a three-section waveguide twist with three waveguide twist sections arranged between a first waveguide flange or waveguide structure and a second waveguide flange or waveguide structure, the first and second waveguides of the first and second waveguide flanges or waveguide structures the waveguides of the twist sections forming angles with adjacent twist sections and with the respective adjacent first and second waveguide flanges or waveguide structures such that the sum of said angles correspond to the waveguide twist angle.

27. The transition arrangement according to claim 26, wherein the transition arrangement comprises a three-section waveguide twist with a twist angle less than 180°.

28. The transition arrangement according to claim 26, wherein the transition arrangement comprises an intermediate twist section arranged between the two other, outer, twist sections, and wherein the intermediate twist section comprises protruding elements on both sides and the other, outer, twist sections comprise protruding elements only on the sides adapted to face the waveguide flanges or waveguide structures, or wherein the other, outer, twist sections comprise protruding elements on both sides, the intermediate twist section comprising a plate with smooth surfaces.

29. A structure comprising a number of waveguide twists, wherein the waveguide twists are formed by a number of the transition arrangements as in claim 1.

30. A rotary joint comprising a transition arrangement comprising a waveguide twist and a number of gear sets with engagement elements, wherein the waveguide twist is formed by the transition arrangement according to claim 1, wherein the gear sets are rotatable round the respective axes connected to a plate comprising an fixed waveguide structure, a rotatable waveguide structure with a waveguide being fixed to a gear plate with engagement elements, forming another waveguide structure adapted for engagement with a respective first engagement element or tooth section of the gear sets, and wherein between the waveguide structures a rotatable waveguide twist section arrangement with at least one waveguide twist section is arranged which is/are circular with engagement elements, on the outer periphery for engagement with respective second engagement or tooth sections of the gear sets such that the rotatable waveguide structure(s) and the rotatable waveguide twist section(s) will rotate with different speeds depending on with which of the gear set engagement or tooth sections they engage.

31. The rotary joint according to claim 30, wherein the rotary joint comprises a scanning rotary joint.

* * * * *